US008376581B2

(12) United States Patent
Auld et al.

(10) Patent No.: US 8,376,581 B2
(45) Date of Patent: Feb. 19, 2013

(54) LARGE SCREEN PORTABLE LED DISPLAY

(75) Inventors: Lynton W Auld, Rohnert Park, CA (US); Leo Stearns, Petaluma, CA (US); Darin Parnell Smedberg, Santa Rosa, CA (US); Matthew Kengi Meeker, Petaluma, CA (US)

(73) Assignee: PIX2O Corporation, Petaluma, CA (US)

( * ) Notice: Subject to any disclaimer, the term of this patent is extended or adjusted under 35 U.S.C. 154(b) by 128 days.

(21) Appl. No.: 13/128,272

(22) PCT Filed: Nov. 10, 2009

(86) PCT No.: PCT/US2009/063884

§ 371 (c)(1),
(2), (4) Date: May 9, 2011

(87) PCT Pub. No.: WO2010/054380

PCT Pub. Date: May 14, 2010

(65) Prior Publication Data

US 2012/0002357 A1 Jan. 5, 2012

Related U.S. Application Data

(60) Provisional application No. 61/112,825, filed on Nov. 10, 2008, provisional application No. 61/186,968, filed on Jun. 15, 2009.

(51) Int. Cl.
*F21V 21/00* (2006.01)

(52) U.S. Cl. ..... 362/249.02; 362/249.06; 362/285; 362/812; 40/606.02; 40/610; 340/815.45; 345/1.3; 345/55; 345/82

(58) Field of Classification Search ..... 29/428; 296/21; 361/679.01; 40/452, 605, 606.02, 40/610, 733; 340/815.45; 345/1.3, 31, 46, 345/55, 82, 903, 905; 362/97.3, 249.02–249.06, 362/285, 812

See application file for complete search history.

(56) References Cited

U.S. PATENT DOCUMENTS

| | | | | |
|---|---|---|---|---|
| 5,900,850 | A | 5/1999 | Bailey et al. | |
| 6,362,801 | B1 | 3/2002 | Yuhara | |
| 6,677,918 | B2 | 1/2004 | Yuhura et al. | |
| 7,319,408 | B2 | 1/2008 | Temple | |
| 7,821,479 | B2 * | 10/2010 | Zhang | 345/82 |
| 2004/0041743 | A1 | 3/2004 | Ling et al. | |
| 2005/0219171 | A1 * | 10/2005 | Gimbutas | 345/82 |
| 2006/0034039 | A1 | 2/2006 | Van Rens | |
| 2006/0039098 | A1 | 2/2006 | Slikkerveer et al. | |
| 2006/0107566 | A1 | 5/2006 | Van Rens | |
| 2006/0117624 | A1 | 6/2006 | Hillstrom et al. | |
| 2006/0220529 | A1 | 10/2006 | Pawlenko et al. | |
| 2007/0146244 | A1 | 6/2007 | Fukushima et al. | |

(Continued)

FOREIGN PATENT DOCUMENTS

| | | | |
|---|---|---|---|
| WO | 2004007059 | A1 | 6/2004 |
| WO | 2005098978 | A2 | 9/2005 |

OTHER PUBLICATIONS

Intellectual Property Office of Singapore (IPOS) Search and Examination Report, Aug. 27, 2012.

*Primary Examiner* — Stephen F Husar
(74) *Attorney, Agent, or Firm* — Edward S. Sherman

(57) ABSTRACT

A large size display is transportable, being construed of multiple rigid segments containing light emitting diodes (LED's). The rigid segments are linked by hinges or cables so the display is flexible and can be rolled up for storage and transport. The display can be unrolled upward or downwards such as from a protective container, such as a canister or truss. The weight of the display on the linked hinges or the tensioned cables provides sufficient rigidity. Such cables, like a signal and power distribution bus, are connected to the rear of each rigid element. The display can be repaired by removing and replacing selected rigid segments from the front thereof.

21 Claims, 40 Drawing Sheets

U.S. PATENT DOCUMENTS

2007/0285337 A1 12/2007 Maddock
2008/0013292 A1 1/2008 Slikkerveer et al.
2008/0055106 A1 3/2008 Zhang
2008/0212271 A1 9/2008 Misawa

* cited by examiner

FIG. 19A
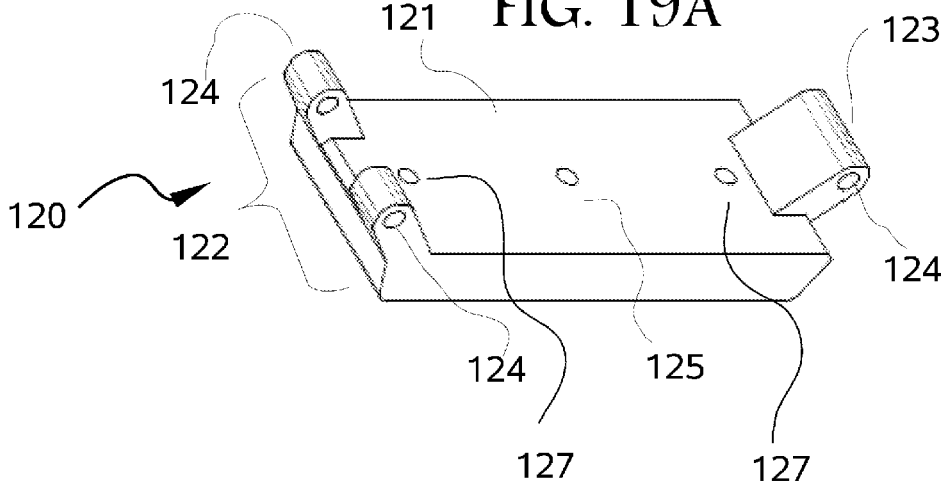
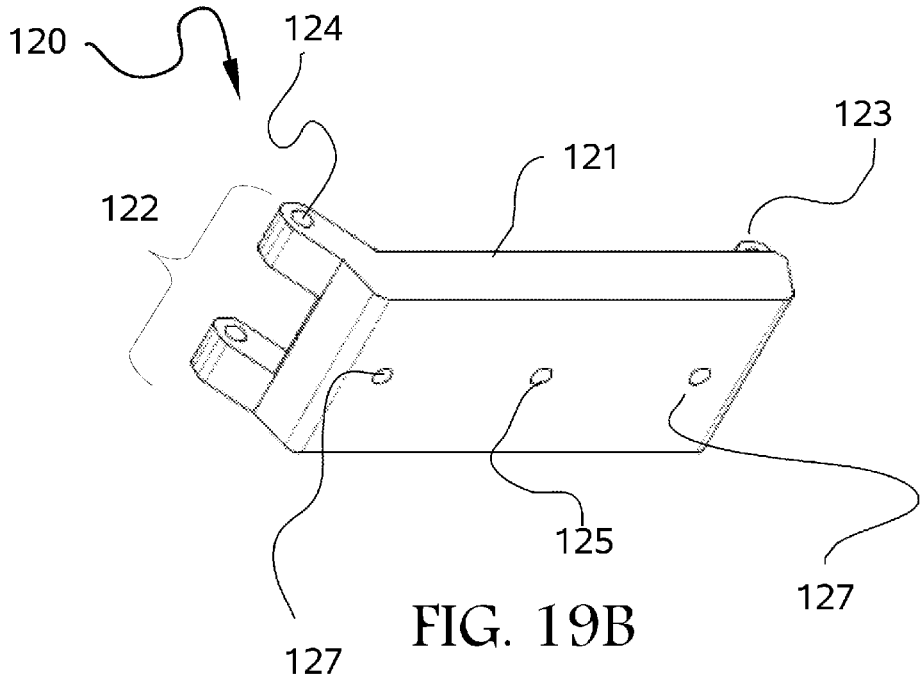
FIG. 19B

LARGE SCREEN PORTABLE LED DISPLAY

CROSS REFERENCE TO RELATED APPLICATIONS

The present application is a Continuation-in-Part of and claims the benefit of priority to the PCT application of the same title that was filed on Nov. 10, 2009, having International application no. PCT/US2009/063884, which is incorporated herein by reference.

The present application claims the benefit of priority to the PCT application of the same title that was filed on Nov. 10, 2009, having International application no. PCT/US2009/063884, which is incorporated herein by reference.

International application no. PCT/US2009/063884 claims the benefit of priority to the U.S. Provisional patent application filed on Jun. 15, 2009, having application Ser. No. 61/186,968, with the title "Electronic Display Assembly", which is incorporated herein by reference.

International application no. PCT/US2009/063884 claims the benefit of priority to the U.S. Provisional patent application filed on Nov. 10, 2008, having application Ser. No. 61/112,825, with the title "Large Screen Portable LED Display", which is incorporated herein by reference.

BACKGROUND OF INVENTION

The present invention relates to large scale electronic displays, and in particular to portable large screen displays.

Large screen displays are commonly deployed at sporting events and other public gatherings, but are generally large fixed installations. While such display can be set temporarily and removed this is very time consuming, in part because it is difficult to identify and repair defects or faulty components in the displays.

It is therefore a first object of the present invention to provide a large screen display that is portable, robust and easy to repair.

It is a further object of the invention to provide a means for transporting and protecting such portable display.

It is a further object of the invention that the portable display is both thin and relatively light weight for portability and storage.

It is a further object of the invention to provide such a display in a variety of portable storage formats for ease of transportation and set up in a variety of venues.

SUMMARY OF INVENTION

In the present invention, the first object is achieved by a portable display comprising: an axle, a plurality of cables attached to said axle in a laterally spaced apart relationship along said axle, a flexible electronic display surface comprising; a plurality of horizontally elongated substantially rigid elements in at least one of a vertical and horizontal array, each rigid element having a front and rear surface and containing a plurality of LED's laterally arrayed to form regularly spaced pixels, the plurality of LED's being connected to a power and signal control module on each rigid element, a flexible signal and power connection between each of the control module on adjacent rigid elements, a bar secured to opposite ends of said cables from said axle, wherein each cable is attached to the rear surface of the rigid elements in each vertical array whereby tensioning said cables provides the regular vertical spacing of the LED's on adjacent rigid elements to provide pixels.

Another object of the invention is achieved by providing a portable display transporter comprising: an elongated vehicle chassis having a least two spaced apart wheels disposed on opposite sides thereof; a canister for containing a rolled flexible display disposed on said chassis having an upward facing opening, two or more rigid support members capable of extending vertically above the chassis at the end of the canister, with each rigid support member having a coupling for driving the upright travel of the flexible array as it is unwound from said canister.

Another object of the invention is achieved by providing an electronic display comprising at least one substantially rectangular elongated blade having a first height and a first width, a front and a rear surface, opposing lateral side that are separated by opposing horizontal sides at the top and bottom thereof, and; a plurality of elongated display boards having a second height and second width, a front and a rear surface, opposing lateral side that are separated by opposing horizontal sides at the top and bottom thereof, and an LED array arranged as a plurality of display pixels on the front surface of each elongated display board, at least one rear terminal connector on the rear surface of each elongated display board for receiving at least one of signals and power that is routed to the LED's of the LED array, wherein the second height is substantially the same as the first height, means for signal and power routing and connection between adjacent elongated display boards in said plurality, a signal-power distribution module having at least one front terminal connector on the front for mating engagement with the at least one rear terminal connector on the back of at least one of the elongated display boards, at least one cable for providing at least one of signal and power to the LED's of each LED array via the signal-power distribution module that extends therefrom behind said at least one elongated blade.

Another object of the invention is achieved by providing such an electronic display wherein the second width is less than about half the first width so that the at least one elongated blade can support at least 2 laterally adjacent elongated display boards.

Another object of the invention is achieved by providing such an electronic display further comprising at least a second elongated blade disposed above and vertically adjacent to the at least one elongated blade that is coupled thereto in a tiled arrangement so that the spacing between the pixels at the horizontal edges of the vertically adjacent elongated blade is the same as the spacing between the pixels within each elongated blade.

Another object of the invention is achieved by providing such an electronic display wherein the respective signal-power cables of at least one elongated blade is attached to the signal-power distribution module of the vertically adjacent elongated blade.

Another object of the invention is achieved by providing such an electronic display wherein the at least one elongated blade is in hinged connection to the second elongated blade.

Another object of the invention is achieved by providing such an electronic display wherein the at least one elongated blade is in hinged connection to the second elongated blade via linked hinges, having at least one hinge disposed to support the signal-power distribution module and the connected elongated blade.

Another object of the invention is achieved by providing such an electronic display wherein the at least one elongated blade is coupled to the second elongated blade by a common frame.

Another object of the invention is achieved by providing such an electronic display wherein each elongated blade is releasably attached to the frame or hinges, the releasable attachment being accessible from the LED containing side of the LED array so that the elongated blade is removable from the frame or hinges from the front surface of the elongated display boards disposed thereon without the need to remove adjacent elongated blades.

Another object of the invention is achieved by providing a flexible electronic display comprising a plurality of horizontally elongated substantially rigid members in a vertical array, each rigid member having a front and rear surface and containing a plurality of LED's laterally arrayed to form regularly spaced pixels, the plurality of LED's being connected to a power and signal control module on each rigid member, a flexible signal and power connection between each of the control modules on adjacent rigid members, wherein each of the rigid members in each vertical array is connected to at least one of an upper or lower adjacent rigid member by a plurality of flexible mating hinges, each having a front side and a back side, wherein the rigid members are disposed on the front side of the flexible mating hinges and at least a portion of the a flexible signal and power connection is disposed behind the back side thereof.

Another object of the invention is achieved by providing such an electronic display or wherein the linked hinges have a rotatingly engaging means that is disposed at a center of gravity of the elongated blade and the hinges connected thereto.

The above and other objects, effects, features, and advantages of the present invention will become more apparent from the following description of the embodiments thereof taken in conjunction with the accompanying drawings.

BRIEF DESCRIPTION OF THE DRAWINGS

FIG. 12A is a perspective view of an assembled portion of the display according to a first embodiment whereas FIG. 12B is an exploded portion of the view in FIG. 12A.

FIG. 19A is a perspective view showing the front side of a first embodiment of the hinge shown in the previous figures whereas FIG. 19B is a perspective view showing the back side thereof.

FIG. 20A is a side elevation of the hinge in FIGS. 19A and 19B, whereas FIG. 20B is a plan view showing the front thereof.

FIG. 25A is an exploded perspective view of an alternative embodiment of the display that deploys a more preferred embodiment of the hinge whereas FIG. 25B is a perspective view of the reverse side of the display board thereof.

DETAILED DESCRIPTION

Referring to FIGS. 1 through 40, there is illustrated therein a new and improved large screen portable LED display, generally denominated 100 herein.

Figure 1:
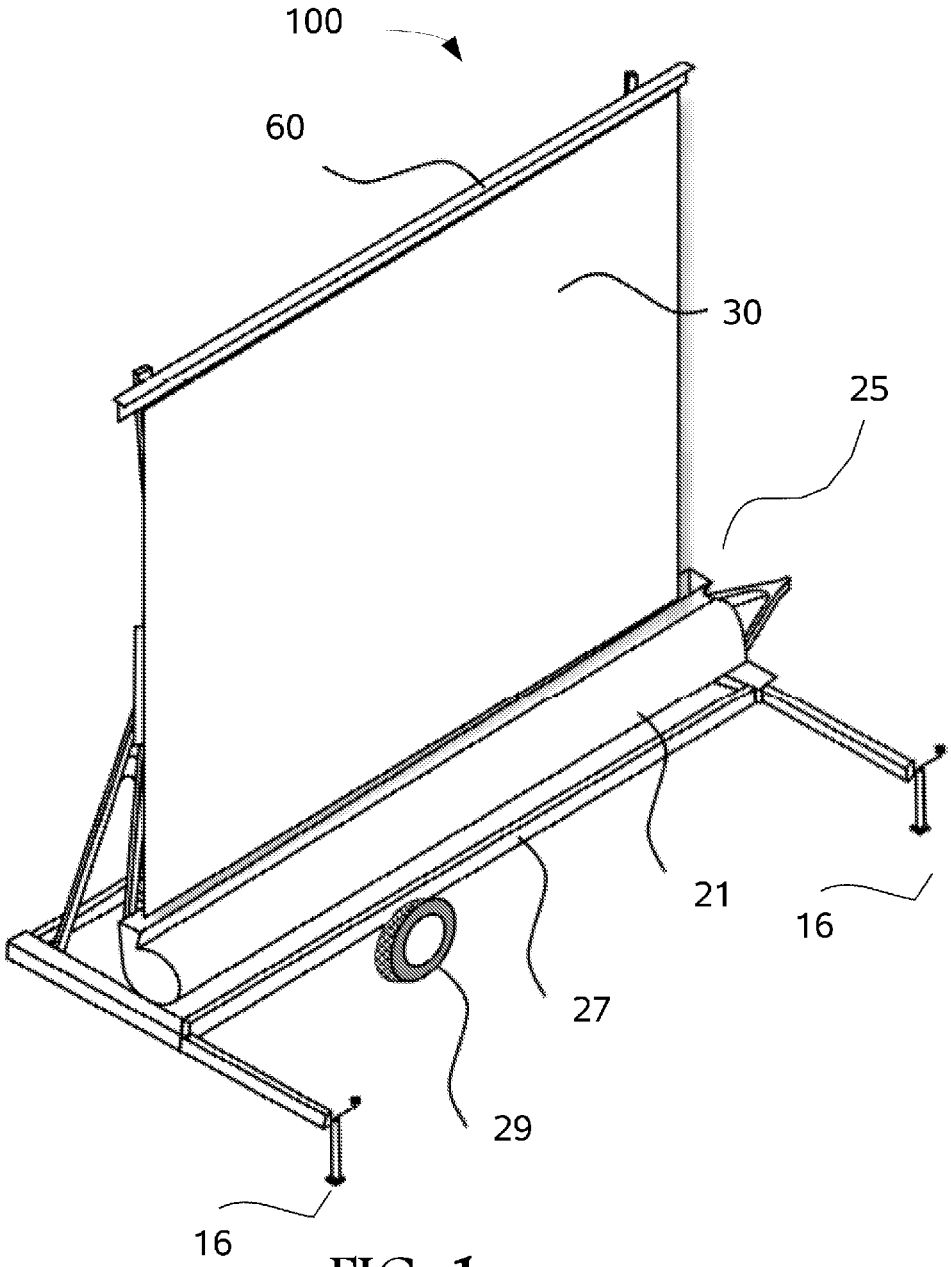
FIG. 1 is a perspective view of the flexible electronic display screen extended from a storage canister on the carrier/trailer for viewing.
Figure 2:
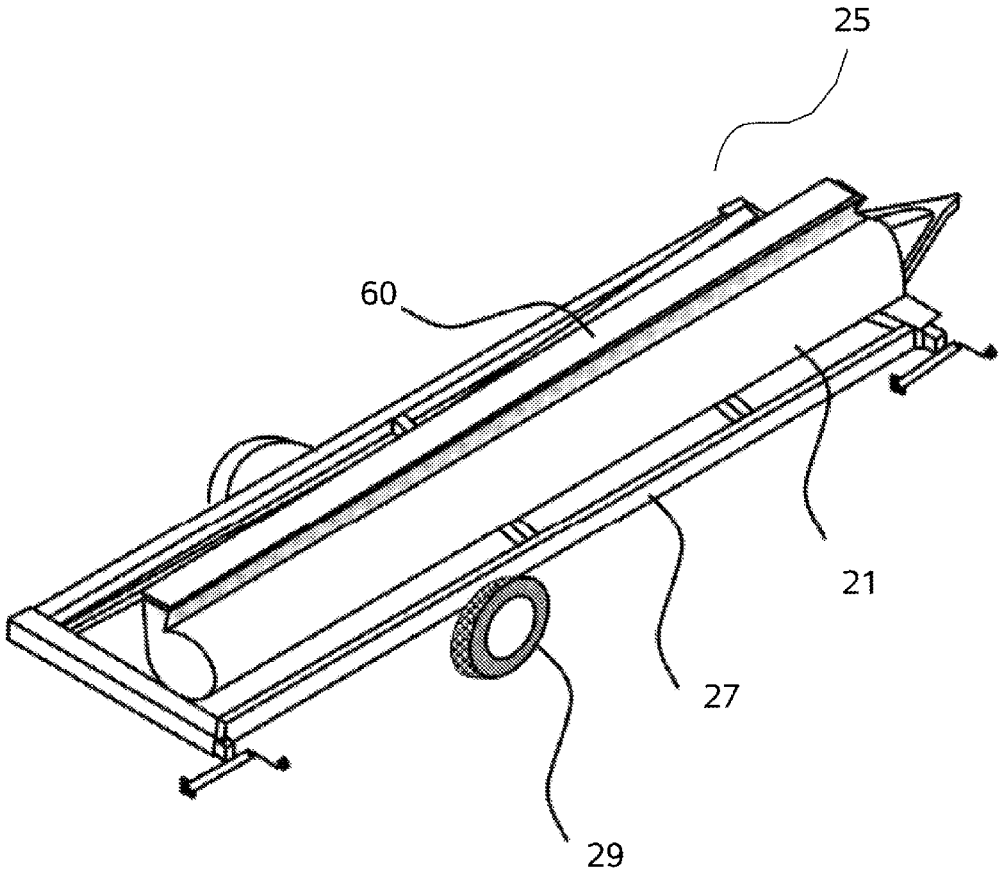
FIG. 2 is a perspective view of the canister on the carrier/trailer as the flexible electronic display screen is retracted therein for storage and transport.
Figure 15:
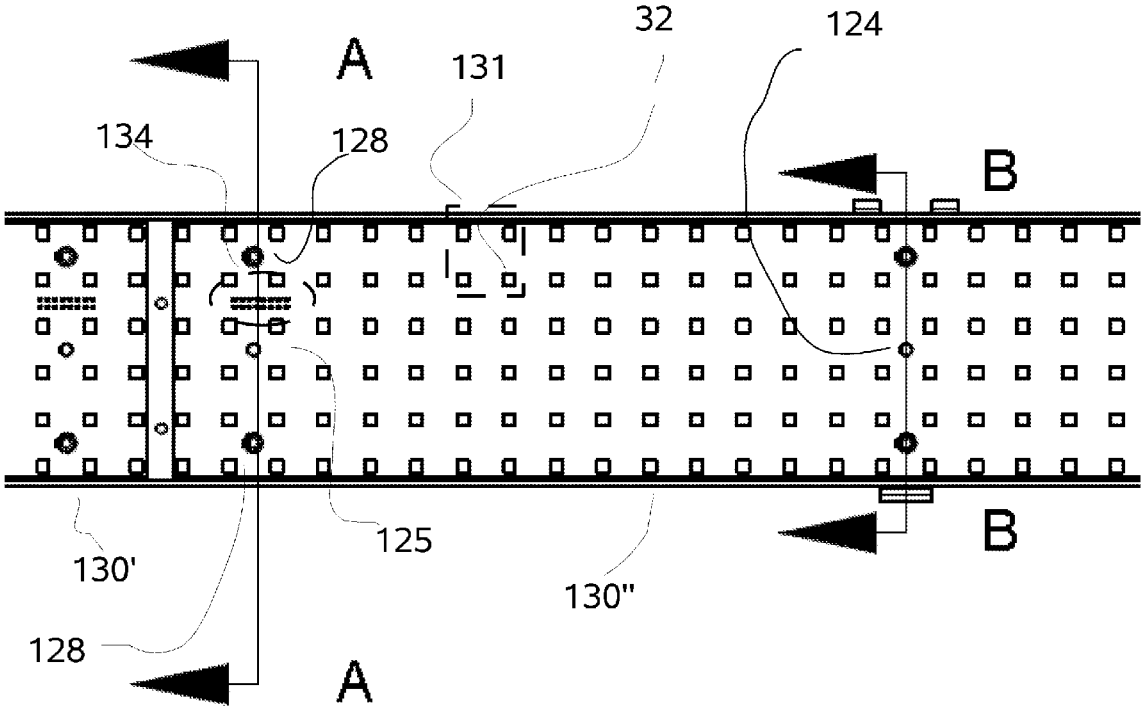
FIG. 15 is a front elevation of the portion of the display in FIG. 12-13 showing the positions for the sections A-A and B-B shown in FIGS. 13 and 14 respectively.

In accordance with a first embodiment of the present invention, FIG. 1 shows a first embodiment of the display 100. The display 100 is comprised of a flexible electronic display surface 30 capable of being wound or wrapped around an axle 10 for storage and transport. The flexible electronic display surface 30 has a plurality of horizontally elongated relatively rigid elements 31 in a vertical array, each element containing a plurality of LED's arrayed to form regularly spaced pixel 32, the LED's having power and signal control interconnections for image display. There is a flexible connection via a connector 40 between horizontally adjacent rigid elements of Flexible Electronic Display surface 30. Such pixels 32 are shown in FIG. 15 in more detail.

In the embodiment of FIG. 1, support cables 20 are attached to the rear of each of the relatively rigid elements 31, to effectively connect them in a hinged arrangement at the fixed spacing necessary to define adjacent pixels 32. One end of these laterally spaced cables 20 are then attached to the axle 10, while the opposite end of the cable 20 are attached to an elongated bar or pull bar 60. Axle 10 is optionally hollow for storing at least a portion of the power and signal distribution cables 704.

Figure 4:
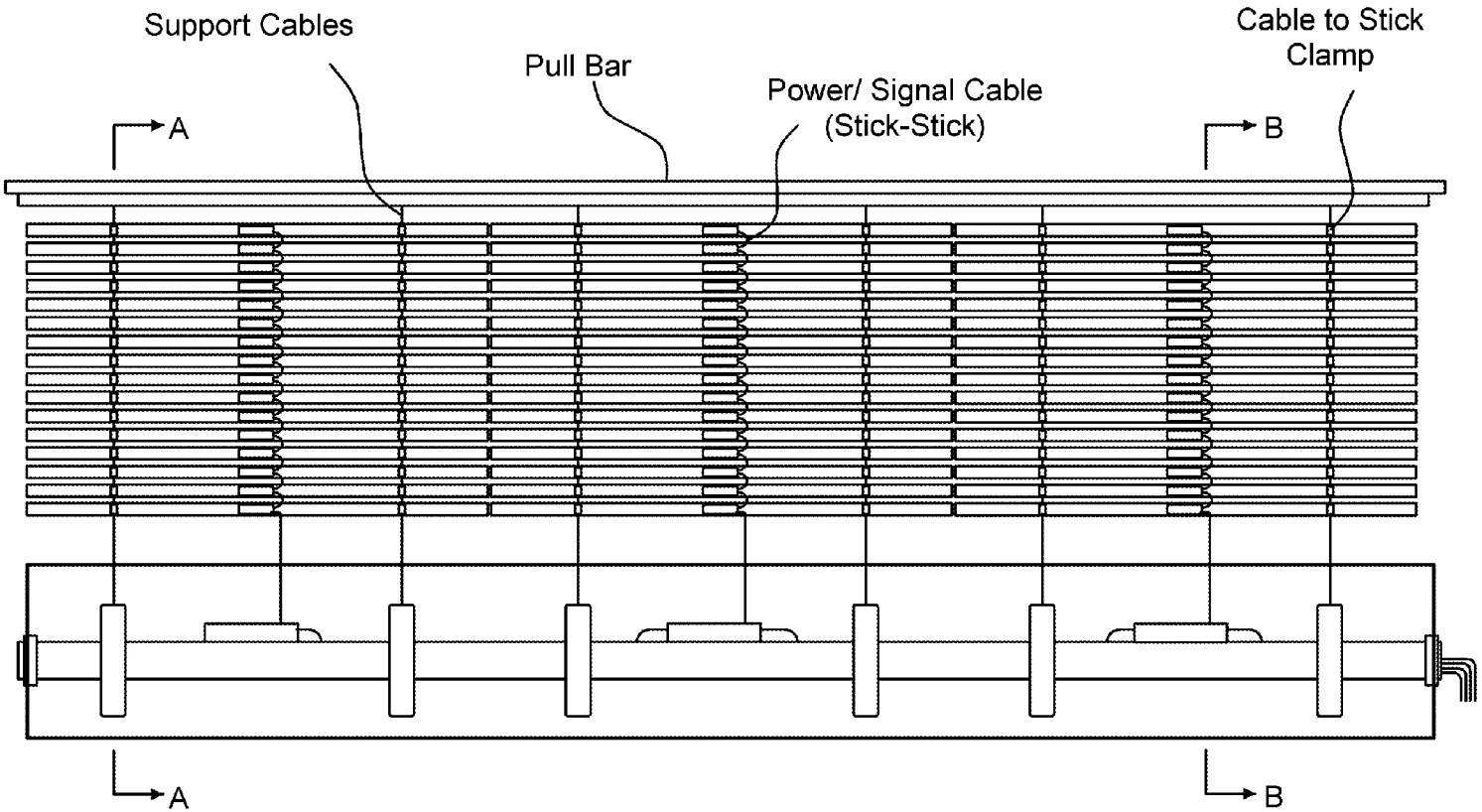
FIG. 4 is a back elevation view of FIG. 3.

It is also preferable that a roll wheel for taking up the cable 20 be mounted on the axle 10. In addition there are holes for cables 20 to enter axle 10. FIG. 4 shows both the support cables 20 and a cable to stick or blade clamp, attached pull bar 60, as well as a Stick Controller/Power Supply to the motor for winding the Power/Signal Cable (Stick-Stick) 505 with the flexible electronic display 100.

Figure 5A:
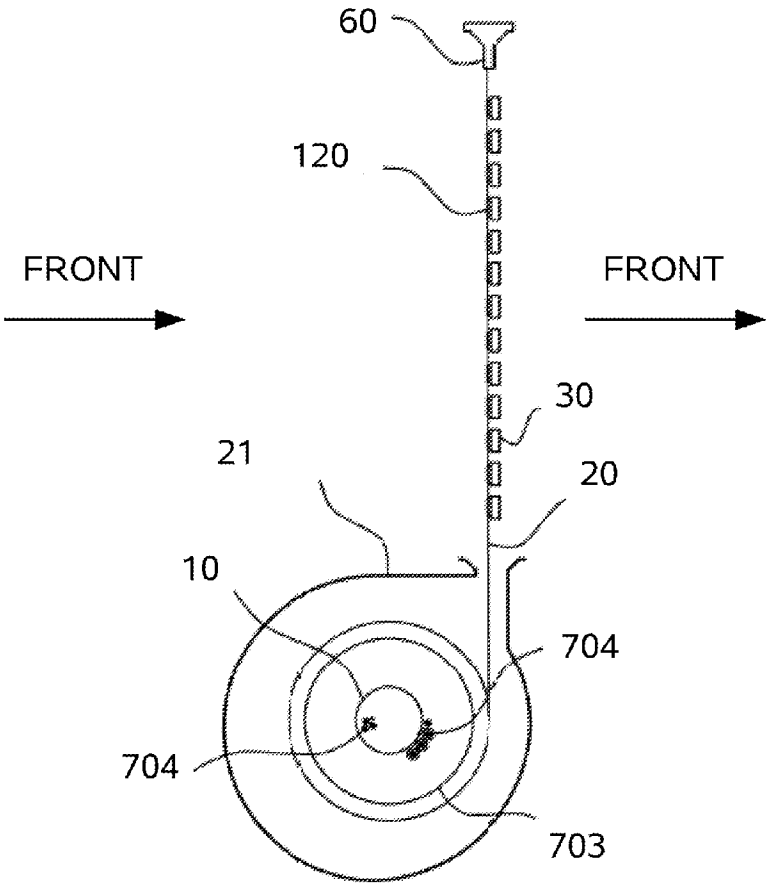
FIG. 5A is a cross-sectional elevation through section reference line AA from FIG. 3 when the electronic display is at least partially extended.

FIGS. 5A and B illustrate the electronic display 100 when extended from Canister 21 by rotation of Axle 10 including the Power/Data Distributor Node 708 with Power and data cables inside shaft or axle 10.

Figure 3:
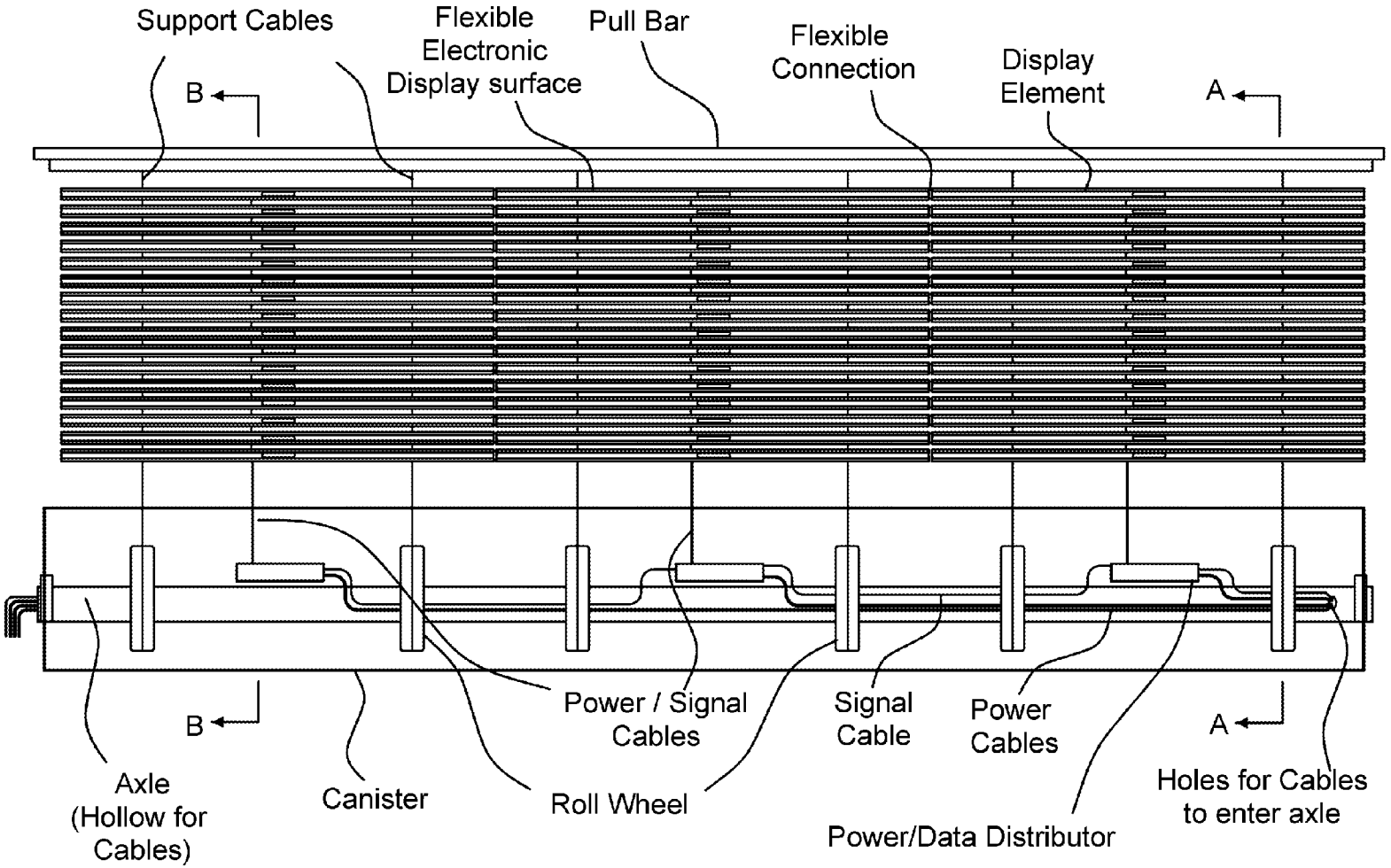
FIG. 3 is a front elevation of the at least partially extended flexible display of FIG. 1 showing further detail of its modular construction and attachment to the axle for storage in the canister.
Figure 5B:
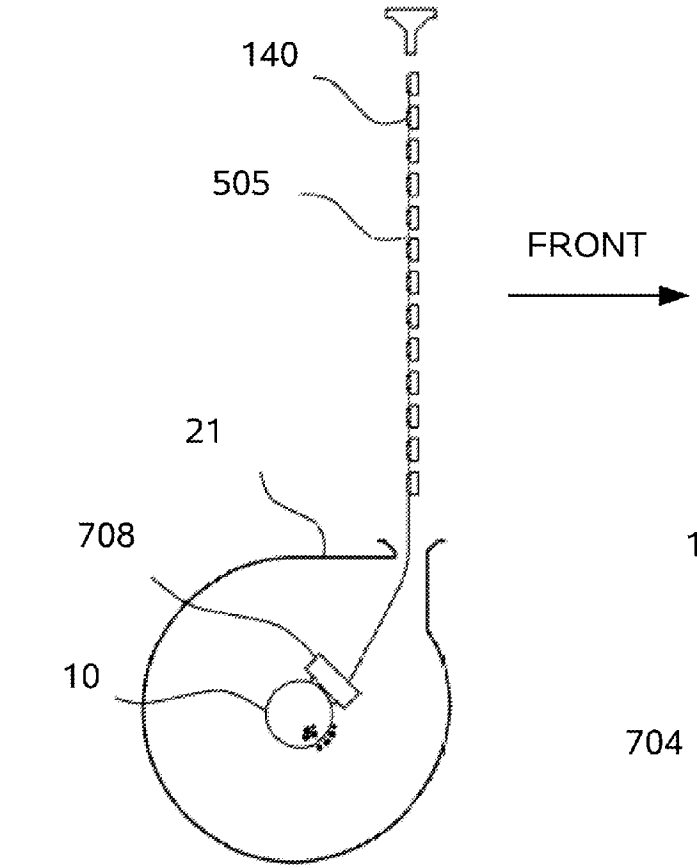
FIG. 5B is a cross-sectional elevation through section reference line BB from FIG. 3 when the electronic display is at least partially extended.

FIG. 5A is a cross-section of the canister with the electronic display 100 extended upward taken as section A-A in FIG. 3. FIG. 5B is a cross-section of the canister with the electronic display 100 extended upward taken as section B-B in FIG. 3 show the Flexible Electronic Display Surface 30 extended by the Support Cable 20.

A plurality of vertical array of relatively rigid carrier elements disposed adjacent to each other. Each rigid element being connected to the laterally adjacent element in the adjacent column by a flexible connector. A canister 21 is provided for containing the axle in rotary engagement at opposite ends and containing the coiled or rolled up display, as shown in FIGS. 5 and 7.

FIG. 6A-6D illustrates in further detail one embodiment for assembling the LED array on the horizontally elongated relatively rigid elements 110 in a vertical array, each element containing a plurality of LED's arrayed to form regularly spaced apart pixel 32, the LED's having power and signal control interconnections 140 for image display, which may include a carrier, controller, power supply of which there are optionally multiple controller with one or more power supplies.

Figure 7:
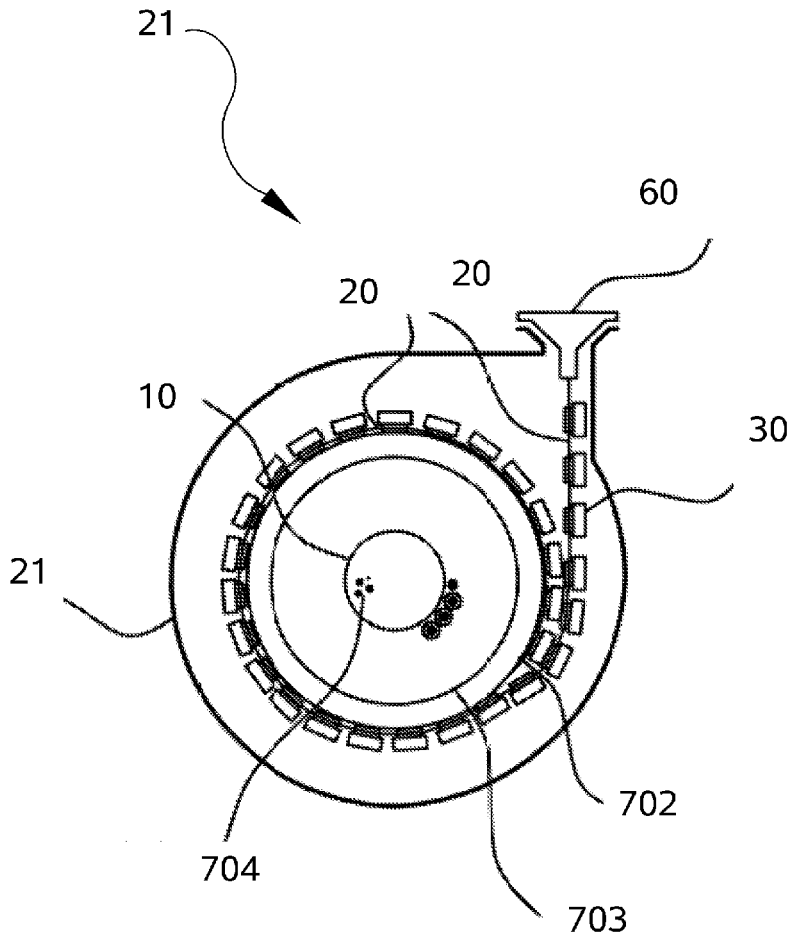
FIG. 7 is a cross-sectional elevation through section reference line A-A from FIG. 3 when the electronic display is refracted within the canister.

FIG. 7 is a cross-section of the canister 21 with the electronic display 100 retracted therein as taken as section A-A in FIG. 3. Pull bar 60 is coupled to the last vertically adjacent set of the rigid horizontal display elements 130. As support cable 20 is wound about axle 10 to roll up flexible electronic display 100 on itself, an alignment ramp 702 is preferably deployed about a portion of axle 10 to guides the power and data cables 704 inside of axle 10 along roll wheel 703.

Figure 8:
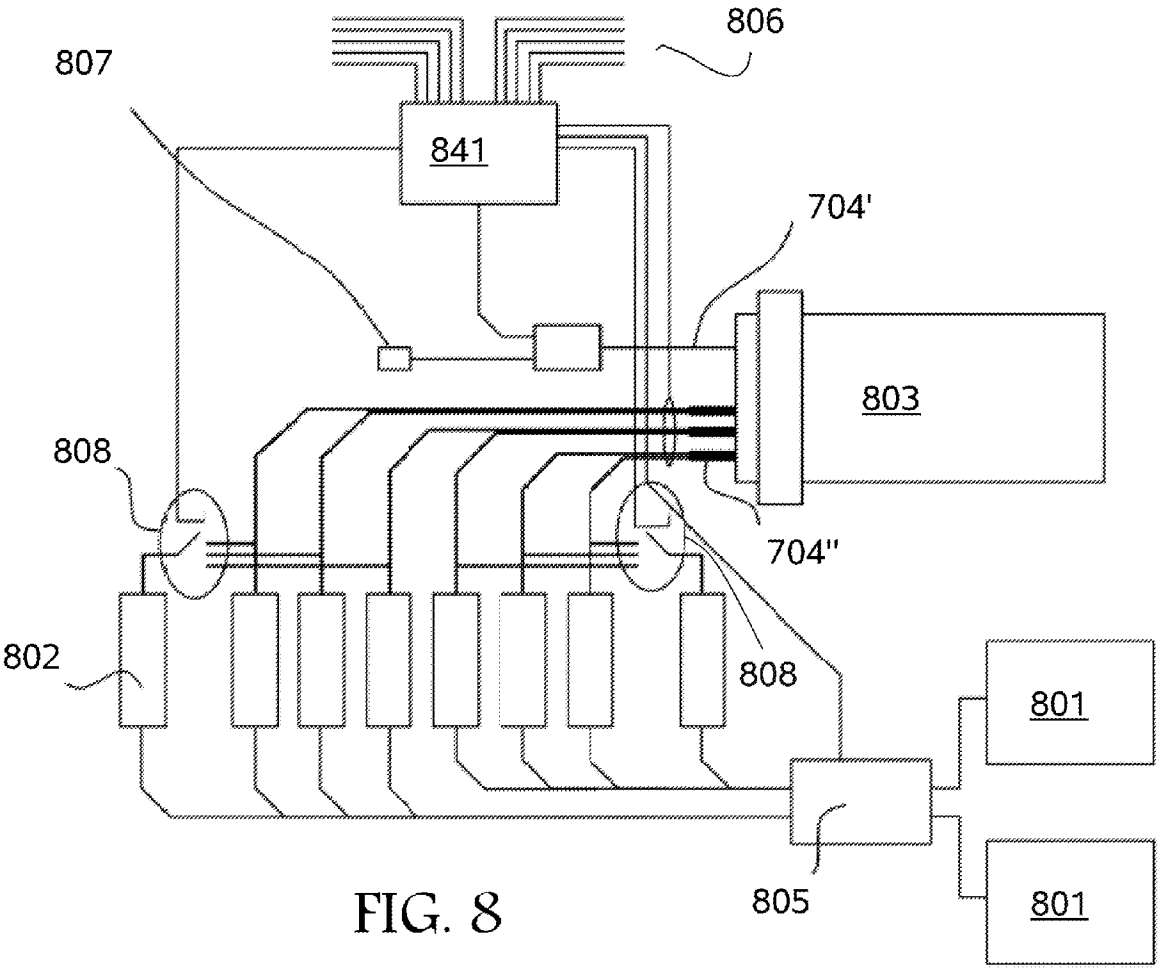
FIG. 8 is an electric schematic diagram of the power and signal distribution to the electronic display and extension/retraction system.
Figure 9:
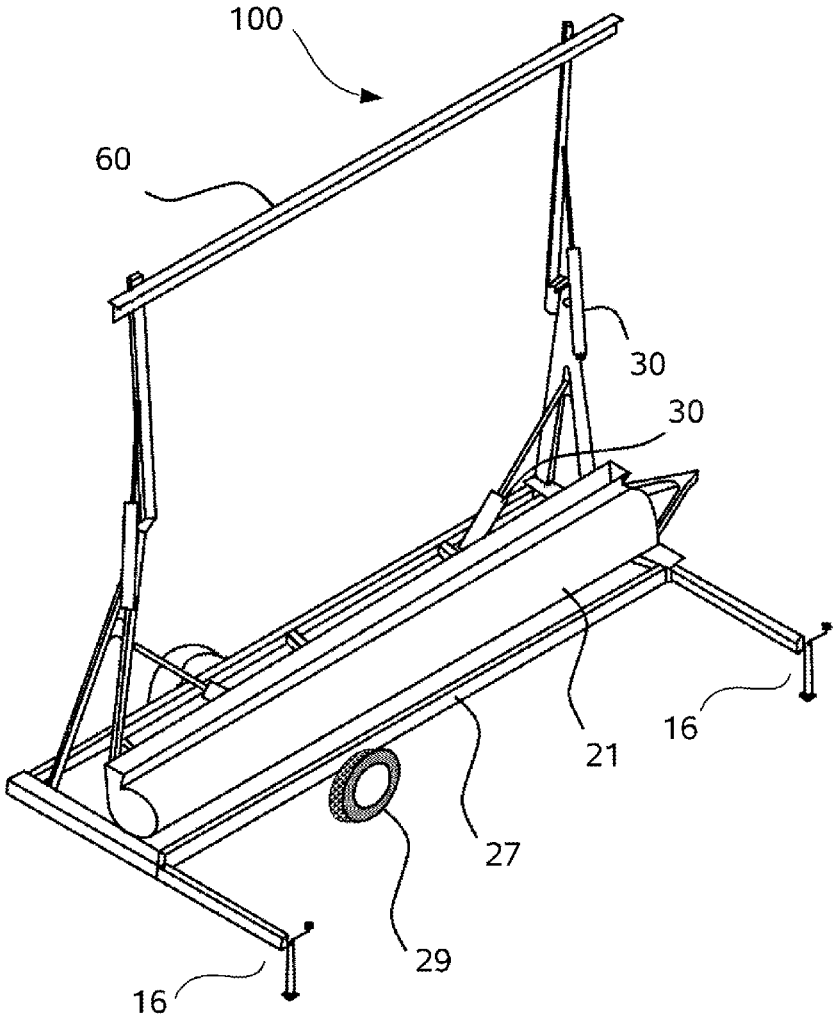
FIG. 9 is a perspective view similar to FIG. 1 but omitting the electronic display screen to show the mechanism for lifting the pull bar or edge of the display screen above the canister.

FIG. 8 illustrates one scheme for the distribution of the power from the Generator Set 801 via rectifiers 802 to the motor 803, which are optional in communication via a trailer controller 804. There is also a power cable generator failover switch 80, as well as an electromechanical interface 806, an optional customer interface 807 (such as an RJ45 interface) and preferably a rectifier fail switch 808.

The term cable is intended to embrace other flexible mechanical members besides ropes and wire cables, such as flexible assemblies of linkages, as for examples chains and bicycle style gear linkages.

Further the term connected means directly connected wherein the term couple means connected directly or through one or more additional member that is commonly connected to element thus coupled. In general, absent words to the contrary elements that are connected directed may be coupled.

The full extension of bar 60 will unwind the flexible electronic display surface 30 as the axle 10 is allowed to rotate in a canister 21 or alternative support or storage structure. When the bar 60 is fully extended to provide sufficient tension to the cables 20 the assembly of the elongated relatively rigid elements 31 becomes rigid and is mechanically stable.

In more preferred embodiments shown in the FIG. 6, four LED's that form a single pixel 32 are arrayed laterally on a leaf or LED display board 130 that attaches to the relatively rigid carrier element or blade 110. The carrier in this embodiment has a matrix of elongated leaves or LED supporting display boards 130, 4 wide and 2 high, with the detail of a single leaf highlighting the LED set that comprises the pixel 32 in FIG. 6D. More generally, each relatively rigid carrier element or blade 110 has at least 2 leaves or LED boards arrayed horizontally.

Thus, the display 100 has the advantage flexible electronic display surface 30 can be fabricated from multiple elongated relatively rigid elements 130 to form a large, >6 ft. wide or tall display for viewing at a large distance at sporting events and large public gatherings. As the display 100 uses LED's it can be bright enough for daylight use. Further the display 100 can have a rapid refresh rate for full color video play.

As the display 100 can be rolled when the tension on the cable is released by rolling the multiple elongated relatively rigid elements 31 about axle 10, the rolled display is portable in that it can be towed on a trailer 25 and stored in a protective canister 21 until it is unrolled for deployment. In addition, as shown in other embodiments, the display 100 is deployable while mounted on the trailer 25. The construction of display 100 provides mechanical stability in moderate wind and weather conditions, despite having a relatively large size.

The modular construction of each of the multiple elongated relatively rigid elements 31 and the sealed connections there between can provide weather resistance. The modular construction of each of the multiple elongated relatively rigid carrier elements 31, shown in FIG. 6, facilitates repair and replacement of defective display elements.

Figure 6A:
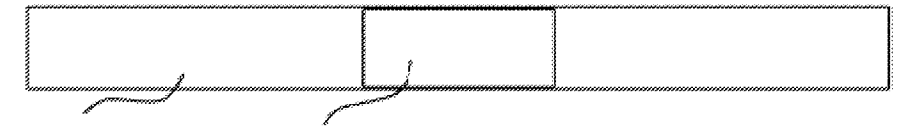
FIG. 6A is a rear elevation view of a carrier segment from FIG. 4
Figure 6B:
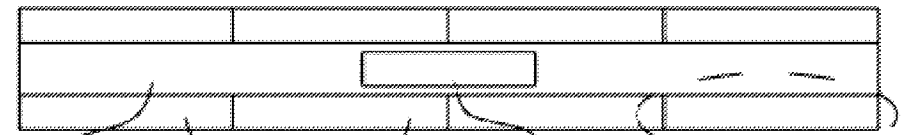
FIG. 6B is a front elevation view of the carrier segment of FIG. 6A
Figure 6C:
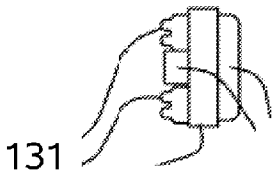
FIG. 6C is a side elevation of the carrier segment of FIGS. 6A and 6B.
Figure 6D:
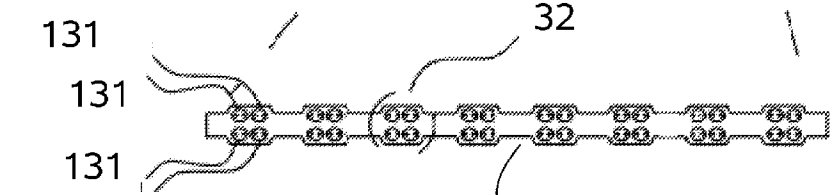
FIG. 6D is a front elevation view of a leaf from the carrier segment of FIG. 6A containing a plurality of pixels.

A power and signal control module on the rear of each rigid element, for powering and controlling the LED's in each leaf of the rigid element. Each control and power distribution module is disposed on the back of the relatively rigid carrier element, as shown in FIG. 6A, which are physically connected in series (FIG. 4) to the corresponding module of the next adjacent relatively rigid carrier element, via a bus that provides a parallel electrical connection. The display 100 can be rolled up for storage and redeployed without the need to disconnect and reconnect the electrical connections to the display 100.

Figure 29:
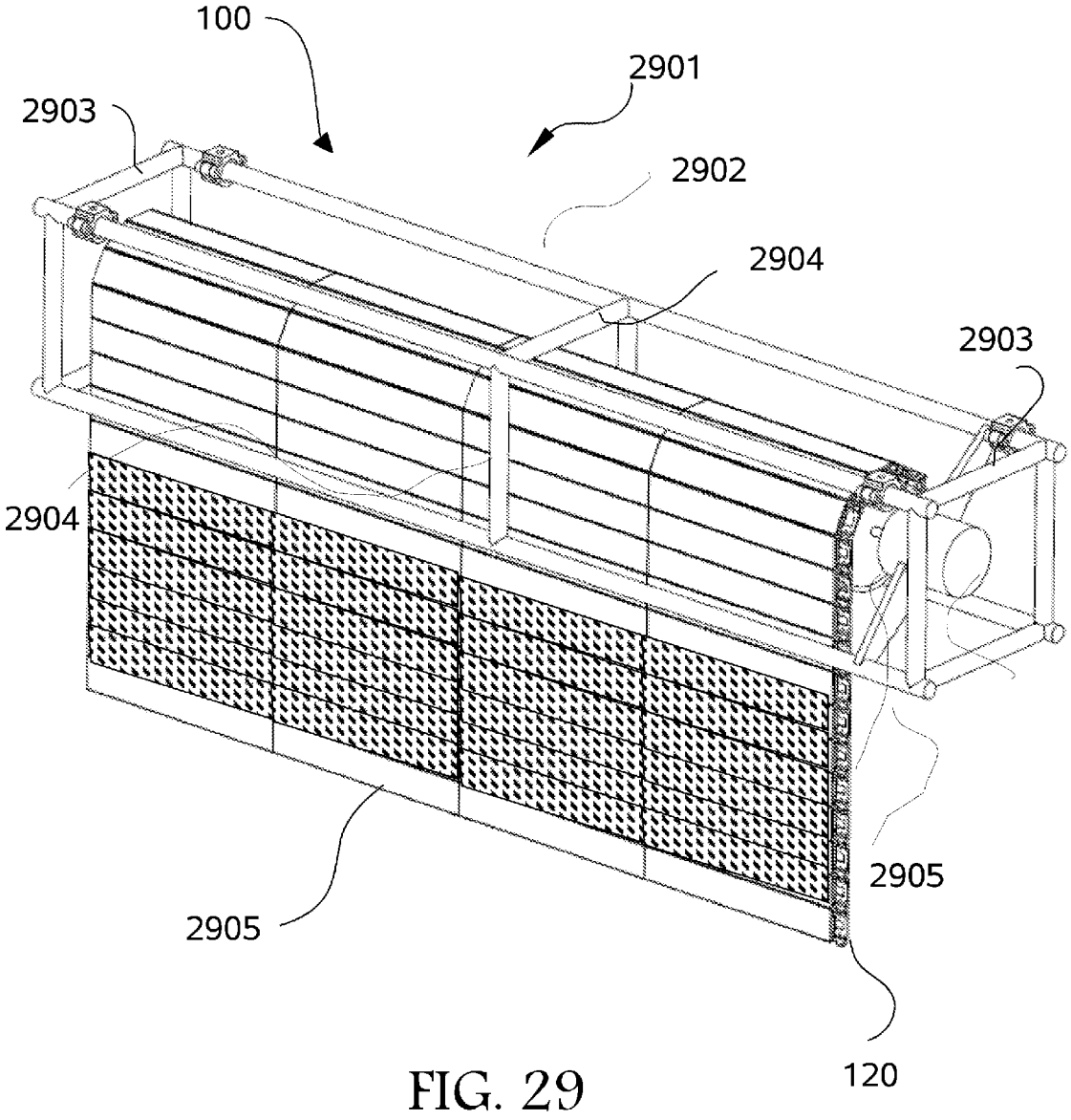
FIG. 29 shows an embodiment of the electronic display in a rolled state ready for deployment in a truss frame that supports the motor and for ease of storage, transport and set up.

FIG. 29 shows an alternative to the canister 21 in the form of a truss member having 4 generally open but rigid sides due to supporting cross beams. The truss member support a motor 803 and roller core or axle 10.

More preferably, each relatively rigid carrier element has protectors, such a soft pads that extend outward to prevent the back surface of one carrier elements, or the components thereon from damaging the front of another carrier elements, such as the leaves and the LEDs, when the display is rolled axle for storage or dispensed from the canister 21 for use.

As shown in FIG. 3 a signal and power distribution bus is disposed about the axle for making parallel connections to each of the control and power distribution modules in the vertical column of rigid elements Further, the lack of an edge support element in the deployed condition provides for seamless tiling of multiple displays 100 into larger display assemblies', such as to create wide screen panoramic views.

The display is of a width or height of at least 6 ft, which is large enough for viewing at a large distance at sporting events and large public gatherings.

The display emits light of a sufficient brightness for it to visible in outdoor daylight use.

The video content of the display is capable of being refreshed at a rate which is sufficiently rapid to display full color motion video.

As shown in FIGS. 1, 2, 9 and 10, the display can be towed on a trailer 25 and can be stored in a protective canister 21 mounted on the trailer 25 until is unrolled from this canister 21 for deployment (FIG. 1). Further, display can be deployed from the canister 21 without the need to remove the canister 21 from the trailer 25.

Further, the lifting mechanism and cable stabilize the extended display in moderate wind conditions, despite its relatively large size.

The display is weather resistant so it can be safely operated in the presence of precipitation.

The physical connection of the power and control modules is a flexible cable or wire capable of rolling with the rigid elements, being at least as flexible as the cable. Preferably, the multiple cables attach to the rear of each relatively rigid carrier element, being deployed on opposite side of a centrally disposed power and control module.

The axle 10 has a central spindle and a plurality of larger diameter rollers laterally spaced apart for supporting rigid elements when cables are wound onto the rollers as the axle is rotated.

FIGS. 1, 2, 9 and 10 illustrate a vehicle chassis 27 with at least 2 wheels 29 for transporting the rolled or coiled display 100. The canister 21 for containing rolled flexible display is horizontally disposed on the chassis 27, preferably having the principal axis of the canister 21 orthogonal to the wheel axis.

Rigid support members capable of extending vertically above the chassis 27 at the end of the canister 21, having a means to constrain the upright travel of the bar therein as display is unwound from canister 21. The means to restrain the upright travel of the bar is a bar, cable or a lever arrangement is driven by a hydraulic, pneumatic, electric or manual power. Preferably, the display blanks itself off as it rolls up (and can turn itself back on as it unrolls).

The transport system of FIGS. 1, 2, 9 and 10 further preferably comprises means to automatically retract the display in adverse weather conditions in to the canister 21. For example, the display stows itself when the wind reaches a specific measured speed (in outdoor configuration) by the anemometer 1101 shown on the mast or vertical support arm in FIG. 11.

This anemometer 1001 for measuring wind speed is optionally in signal communication with a controller of the display refraction means. The automated means can include a radio beacon to receive weather forecasts and emergency alerts, as well as a GPS to determine location and compare with measure forecasts and reports, as well as using the output of force and/or motion sensors mounted on display supports or cables.

Alternatively, the display canister 21 may be disconnected from the transport trailer 25, and may be suspended horizontally from above. In this configuration, the display deploys by unrolling vertically downwards.

In another embodiment, the display canister 21 may be disconnected from the transport trailer 25, and suspended vertically. In this configuration, the display 100 deploys by unrolling horizontally.

The display 100 can be deployed on or off the trailer 25. The trailer 25 includes various mechanical stabilizers 16 that extend down to the ground when the display is parked.

A power supply is either an electrical cable or generator 801, such as shown in FIG. 8, which can be included on the trailer 25 as its own portable power supply, to both power the display 100, as well as the extension retraction mechanism that is the means to unroll the electronic display 100 from the canister 21 by driving the pull bar 60 upward. In one embodiment, the unroll means is a lever arrangement, shown in FIGS. 9 and 10, powered by hydraulic, pneumatic or electrical actuators 1001. This may include a tilt sensor (on the bar used to control the actuators to maintain even tension on the cables. The display screen is omitted from FIG. 10 to better illustrate the other operative components of the device, which includes 2 sets of upper 1002 and lower arms 1003 that are in a hinged arrangement at a common end 1004 between the pull bar 60 and the chassis. Each of the arms in the upper pair are hinged at or near opposite ends 60*a* and 60*b* of the pull bar 60. Between the upper and lower ends of each pair of bars there are separate pairs of hydraulic actuators 1001 and 1001'. The first pair or lower pair of actuators 1000' are coupled to the chassis 27 via rotating hinges 1002 before the near the ends 27*a* and 27*b* thereof, from which lower arms 1003 pivot via a rotary hinge. The other ends of the lower actuators are in a hinged connection to the lower arms 1003 before their hinged connection 104 to the upper arms 1002. The upper pair of actuators 1000 is likewise in hinged connection to the pull bar 60 between the ends a 60*a* and 60*b* and the midpoint, and at the opposite end to circa the midpoint of the upper arms 1002. Thus, the activation of all four actuators in pairs 1000 and 1000' lifts the pull bar 60 parallel to the chassis 27 to raise the electronic display 100. As described in other embodiment wherein the cable 20 is a set of hinges, it is preferable to use a motor 803 to lower the electronic display 100 from a raised position.

Figure 11:
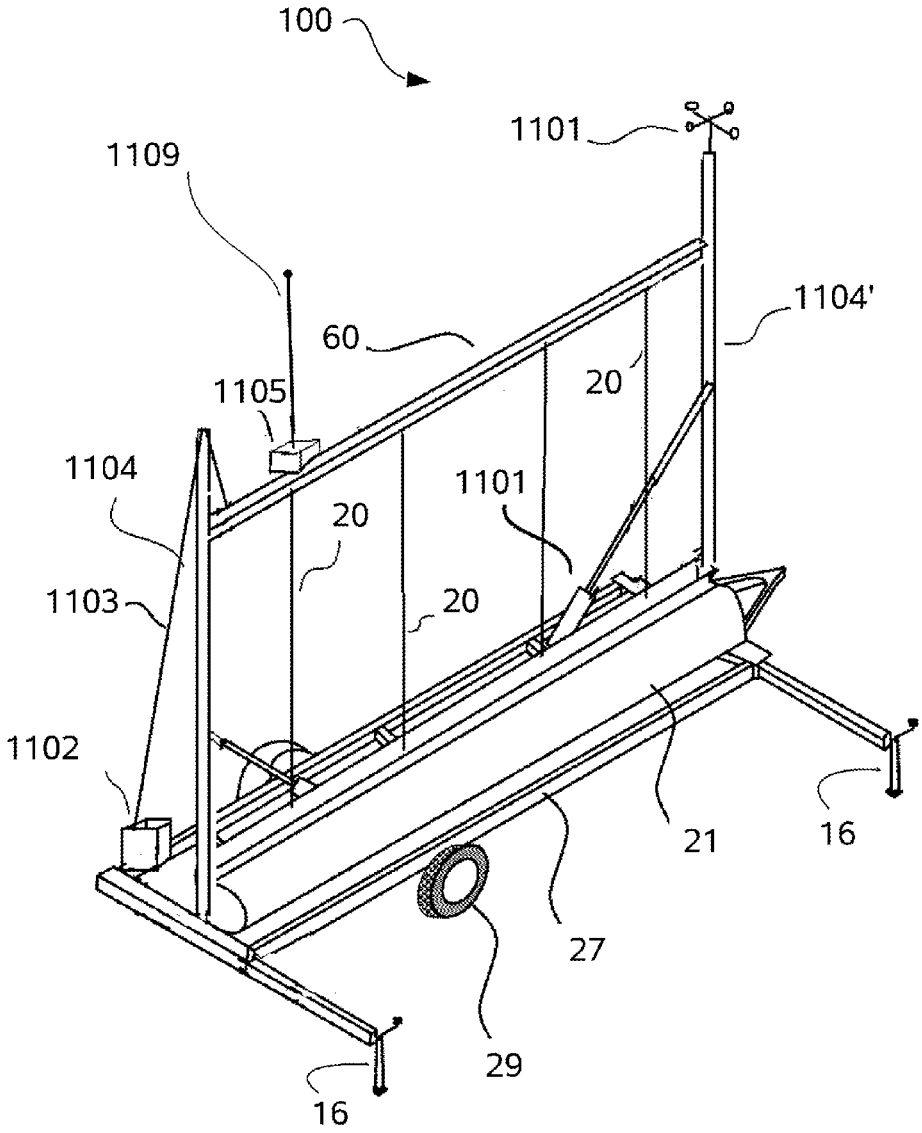
FIG. 11 is a perspective view of another embodiment of the partially extended electronic display screen on a trailer.

Alternatively, as shown in FIG. 11, the unroll means is a winch 1102 connected to the pull bar 60 via a hoisting cable 1103. Two or more rigid support members 1104 and 1104' extending vertically above the chassis 27 at the end of the canister 21, each rigid support member having a channel or rail for constraining the upright travel of at least the pull bar 60 to extend the flexible array upward as it is unwound from the canister 21.

Further, the display 100 and related system may include a broadcast receiver or transponder 1105 for receiving images, messages and the like from a wide broadcast stream (i.e. advertising) via antenna 1009.

FIG. 12-37 generally illustrate various aspects of another embodiment of the electronic display 100 has a plurality of horizontally elongated relatively rigid elements 31 in a vertical array, each element containing a plurality of LED's arrayed to form regularly spaced pixel 32, the LED's having power and signal control interconnections for image display. In an alternative embodiment of the invention, shown in FIGS. 12 and 13, the cable need only be attached to the pull bar 60 or a header bar, when the horizontally elongated relatively rigid elements are connected to each other through a rear hinge.

The electronic display surface 30 can be flexible depending on the mounting and connection of the elongated blades. In the embodiment shown in FIG. 36-37 selected components are mounted to a rigid frame 420, however the preferred embodiment of the construction, including the connector and bus, enable complete assembly, repair and maintenance from the front surface where the LED's are visible to viewers or an audience.

Figures 12A, 12B:
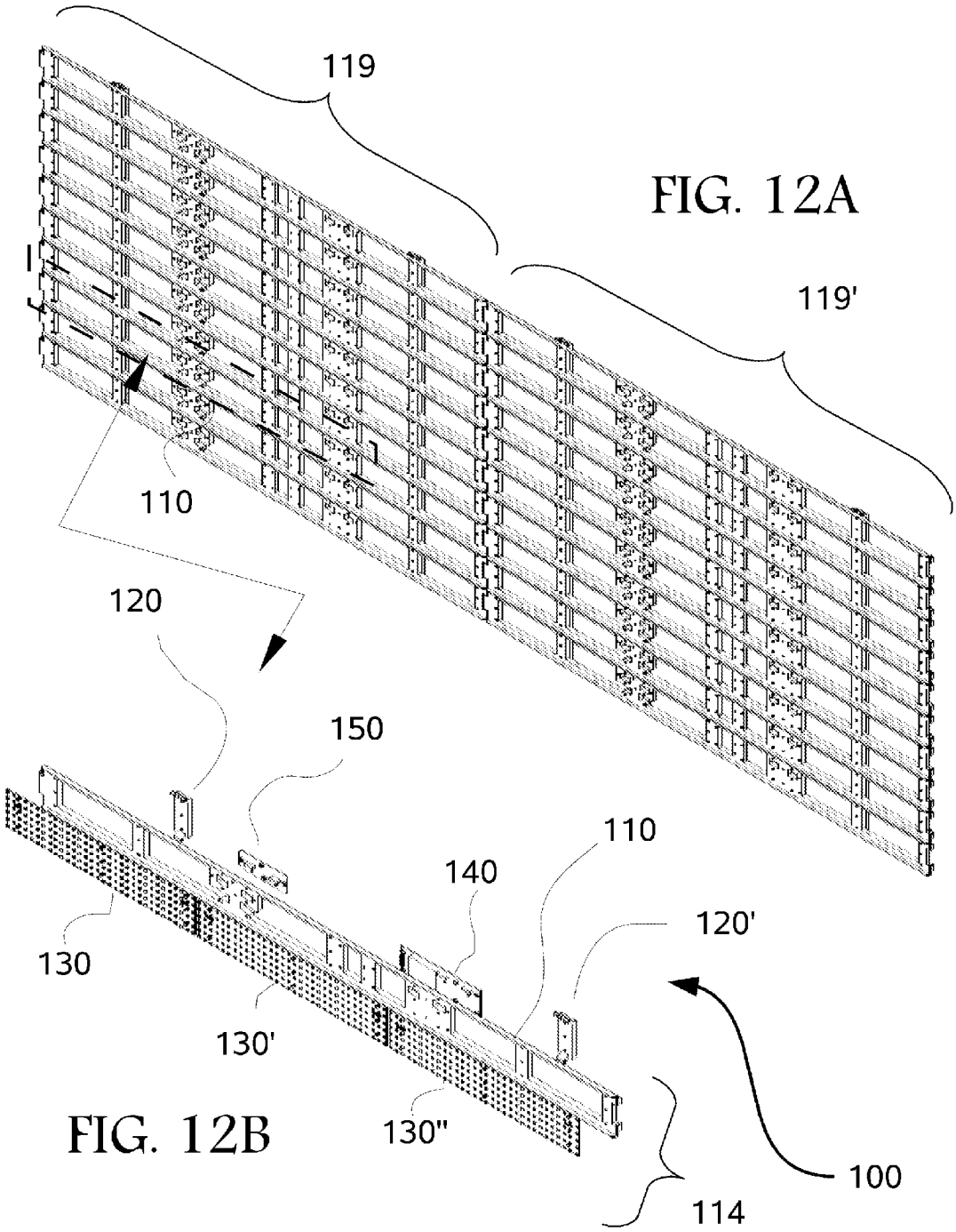
Figure 13:
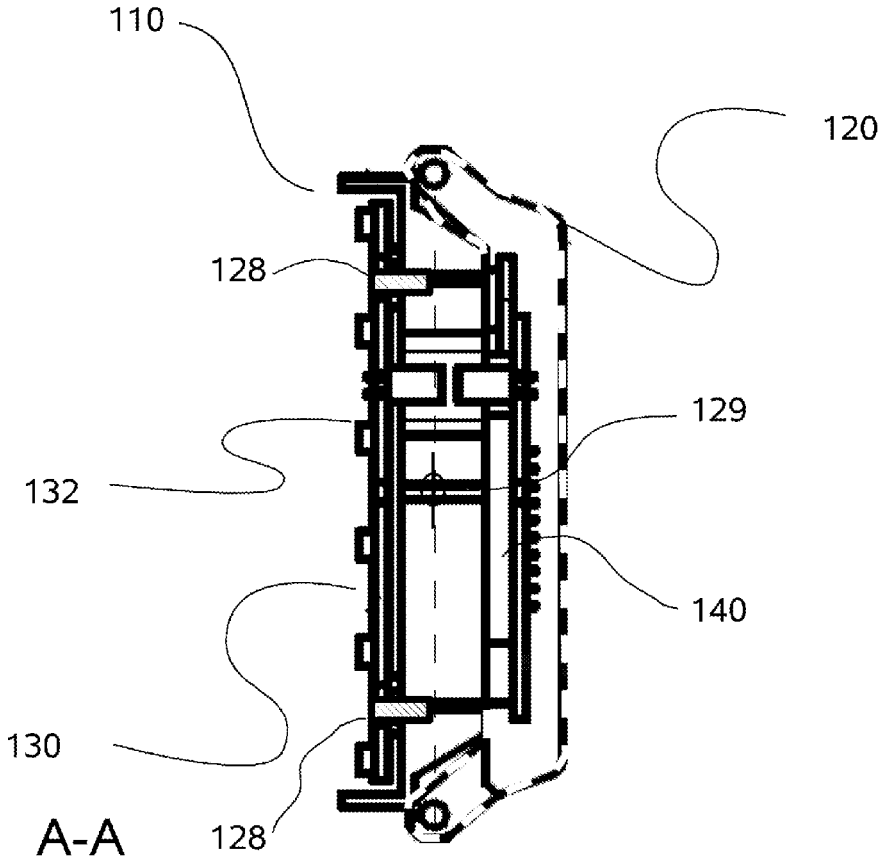
FIG. 13 is a cross-sectional elevation of the portion of the display of FIGS. 12A and 12B, taken at the position A-A illustrated in FIG. 15.
Figure 17:
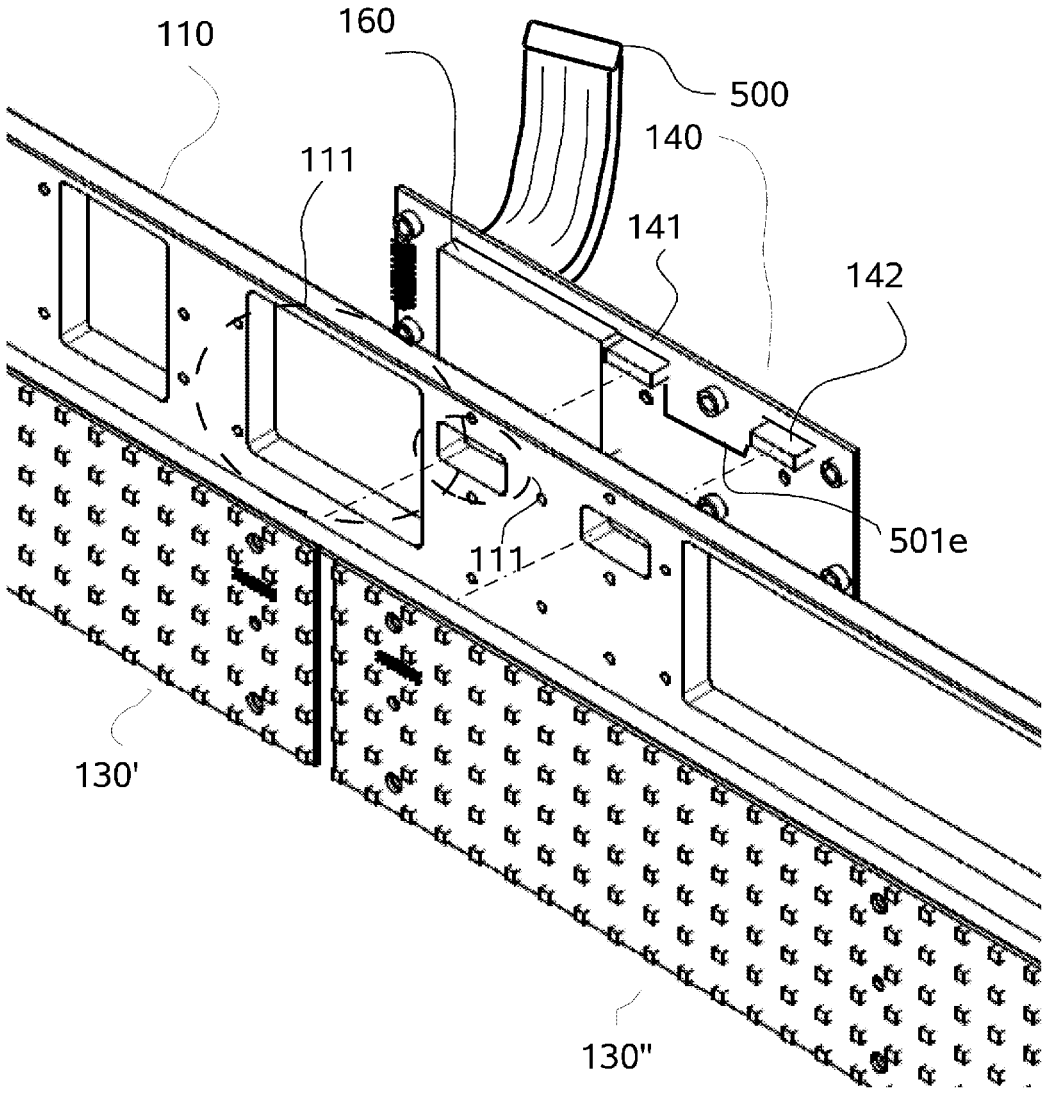
FIG. 17 is an enlarged portion of the exploded view in FIG. 16.
Figure 18:
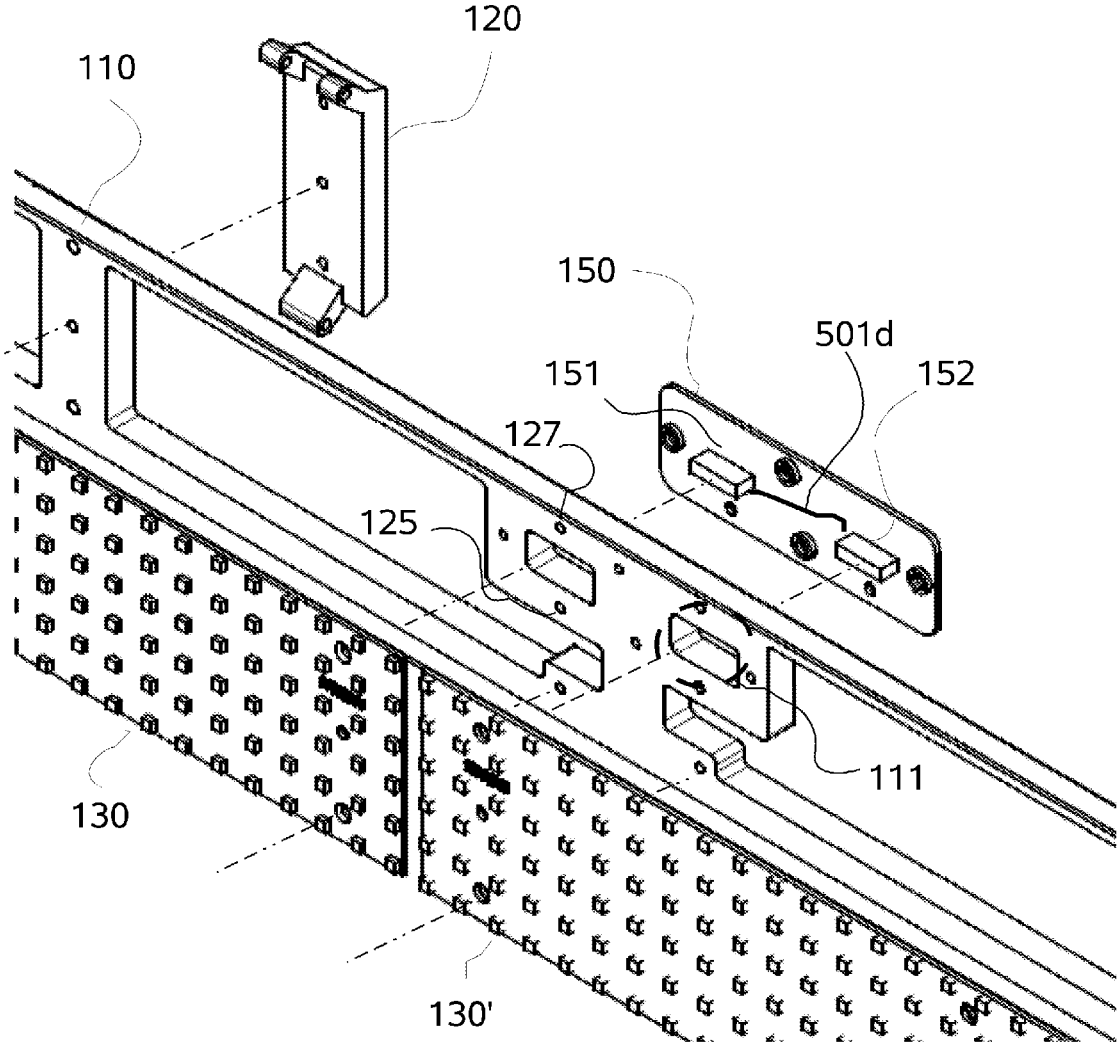
FIG. 18 is a different enlarged portion of the exploded view in FIG. 16

In accordance with such an alternative embodiment of the electronic display 100 FIGS. 12A and 12B illustrates the primary elements of a showing exploded components of a horizontally elongated relatively rigid elements 31 formed as a blade assembly 112 that are connected by mating hinges 120. Accordingly, the display 100 comprises a plurality of horizontally oriented blade assemblies 114 that themselves comprise rigid elongated support members 110 (which will also be referred to herein as blades) having at least two mating hinges 120 and 120' per horizontally oriented elongated member or blade 110. FIG. 12A shows such a vertical array 119 of the blades 110 absent the other components to further illustrates how a plurality of vertical arrays 119 and 119' are joined horizontally to form a matrix of display components. FIG. 11B shows in an exploded perspective view the components of blade assembly 114 attached to just a single blade 110. The hinges 120 and 120' are connected to the back of the blade 110 being spaced apart from each other and the vertical edges of each blade 110. Although the hinges 120 may be part of the blades, it is in fact preferred that they are separate elements as described further below to facilitate construction, assembly and maintenance. Two or more LED display boards 130 are disposed edge to edge on the horizontally oriented elongated member 110 being placed on the front, which is the side opposite hinges 120 and 120'. In this example, three sets of LED boards 130, 130' and 130" are attached to the front of blade 110. A signal-power distribution module 140 includes a power distribution board 160 and is mounted to back of blade 110 and is in electrical connection to LED boards 130' and 130" via plug and socket types connectors 141 and 142 that extend through blade 110, as shown in FIG. 17, via apertures 111. The signal-power distribution module contains active components that decode the signal encoding the image to be displayed and route such signal to controllers or switch that control which pixels 32 receive power and the power level, depending on the image encoding and multiplexing scheme. LED display board connector 150 is also mounted to back of blade 110 and is in electrical connection to LED boards 130 and 130', as shown in FIG. 18. The LED board connector in this embodiment has 2 multi-pin plugs 151 and 152 that mate with sockets on the backs of the LED boards 130 and 130' respectively. It should be appreciated that plugs 141, 142, 151 and 152 can also be sockets when a corresponding plug is used on the reverse side of the LED boards 130, 130' or 130". Preferably the blades 110 are extruded profiles to lower cost having regularly stamped or cut apertures and holes for connection and alignment with other components as described further below. By deploying the preferred blades 110 connected by the preferred hinges 120, the display 100, including LED boards 130, are less than an inch (25 mm) thick. Such a display 100 also hangs vertically straight when unrolled.

As the horizontal array of the LED boards 130, 130' and 130" are substantially the same width the blade 110, the attachment of the vertical arrays or columns 119 places the left edge of LED board 130 edge to edge with the right edge of LED board 130". The vertical and horizontal separation of the last pixel on each LED board from the boards vertical and horizontal edge is half the pixel width so that assembly of pixels in the display 100 is without gaps or seams, enabling large displays of custom dimensions to be created from the basic unit shown in FIG. 12B. Each of the hinges 120, blades 110 and LED boards 130 has at least one central alignment hole 125 to facilitate assembly to bring the pixels on adjacent blades in to registry. The alignment holes 125 are preferably disposed equidistant between upper dual shackle 122 and lower central shackle 123.

During the fabrication of each blade assembly 114, a pin 125*a* is inserted through the two alignment holes 125 on each LED board 130, such that is also passes through a least the corresponding alignment hole 125 on the blades 110 and, for a least one point or position on each of LED boards 130 and 130", also through the alignment holes 125 on hinges 120 and 120' respectively. Preferably each LED board 130 has 2 alignment holes 125 at opposite ends and each blade 110 has six alignment holes 125 distributed to support the 3 LED boards 130 in a lateral row.

Figures 20A, 20B:
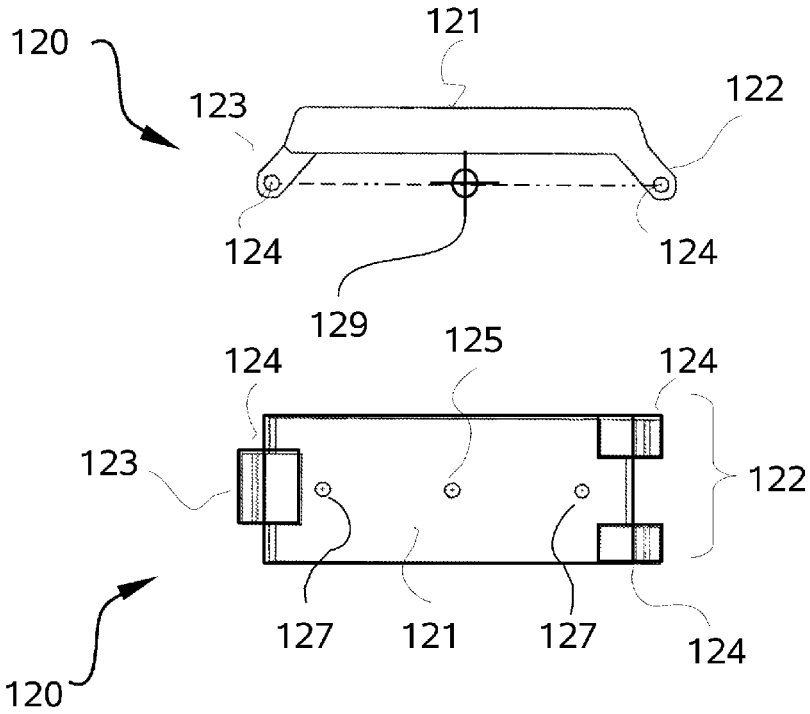

FIG. 19-20 illustrates in more detail the preferred embodiment for the mating hinges 120 for supporting the other display components. Preferably a hinge 120 comprises a generally rectangular hinge plate 121 having disposed a one end an upper dual shackles 122 and at the other end a lower central shackle 123. Thus, the lower shackle of an upper blade 110 is intended to slide between the upper dual shackle pair 122 on the lower blade in a display 110. The shackles 122 and 123 have eyelet 124 at each end for receiving a shackle pin 126 to form a rotary connection there between so that the attached blades are in a hinges connection. Preferably the shackles 122 and 123, as shown. extend at an angle away from the hinge plate surface 121 to dispose the eyelet 124 in a common plane coincident with the center of gravity (COG) 129 when other display components are attached to the hinge plate 121. Thus when the display 100 is assembled, on each blades the hinge plate 121 is recessed from the pivot axis at shackle pin 126 to dispose display components at COG 129 thereof.

Figure 21:
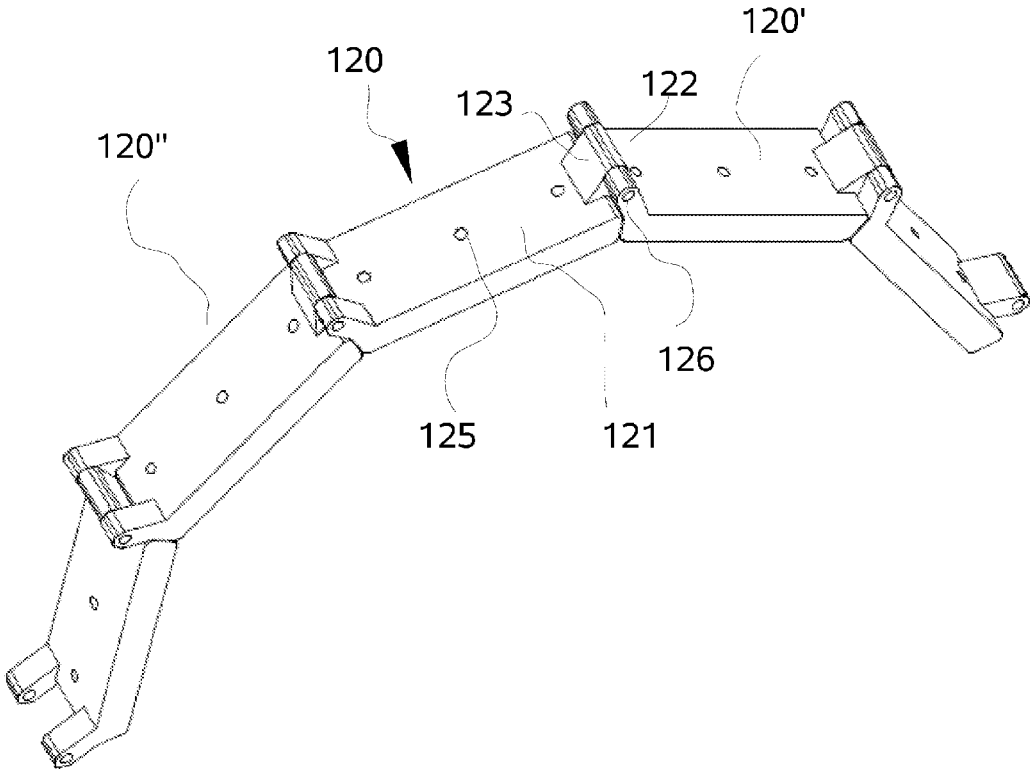
FIG. 21 is a perspective view of an assembly of hinges shown in the previous figures in the configuration when the display is rolled up for storage and transportation.
Figure 22:
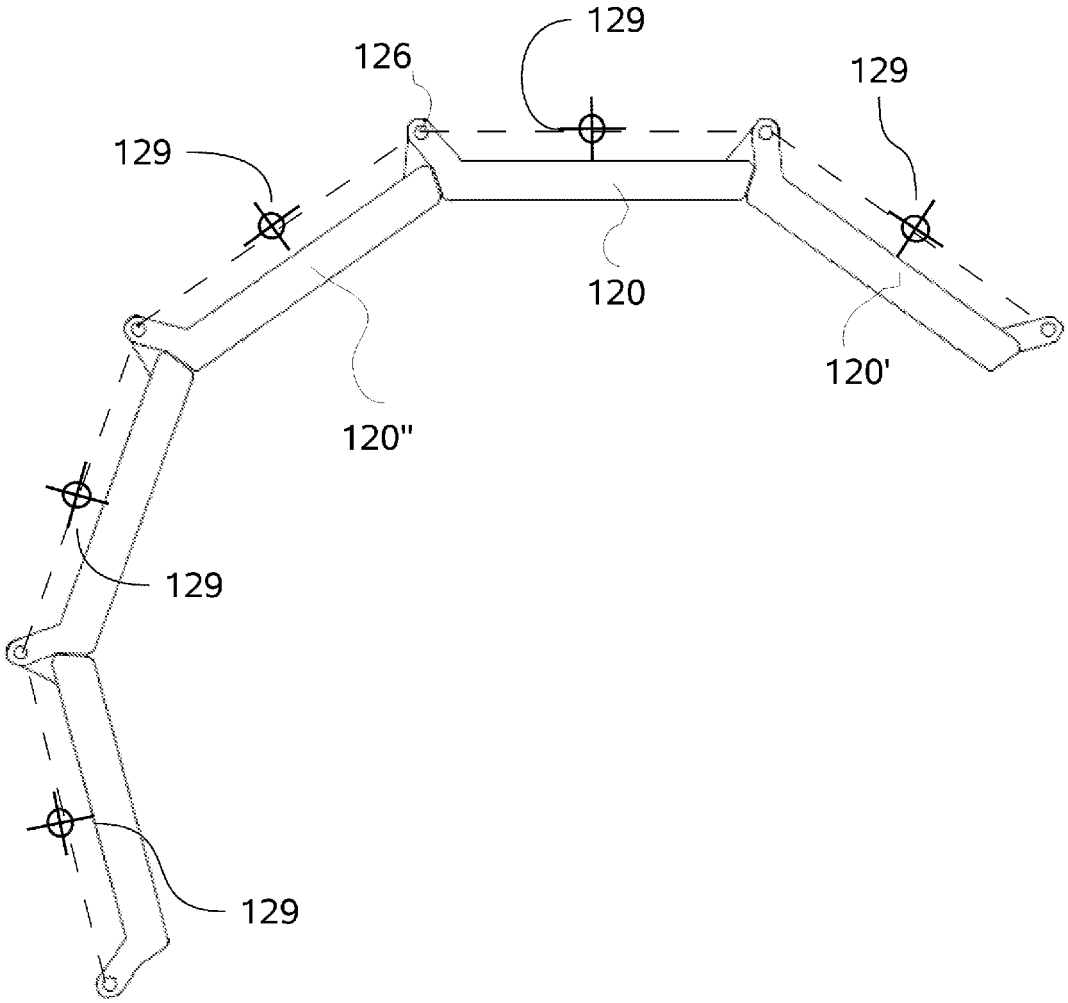
FIG. 22 is a side elevation of FIG. 21.

As shown in FIGS. 21 and 22, this arrangement of hinges 120 allows the blades 110 to rotate with respect to each other to facilitate the rolling of the display 110 for moving or storage, but also assures that when unrolled the display 110 will hang vertically on its own weight. Thus, the use of an edge or side frame is opposition in the final configuration for use with an audience.

Figure 14:
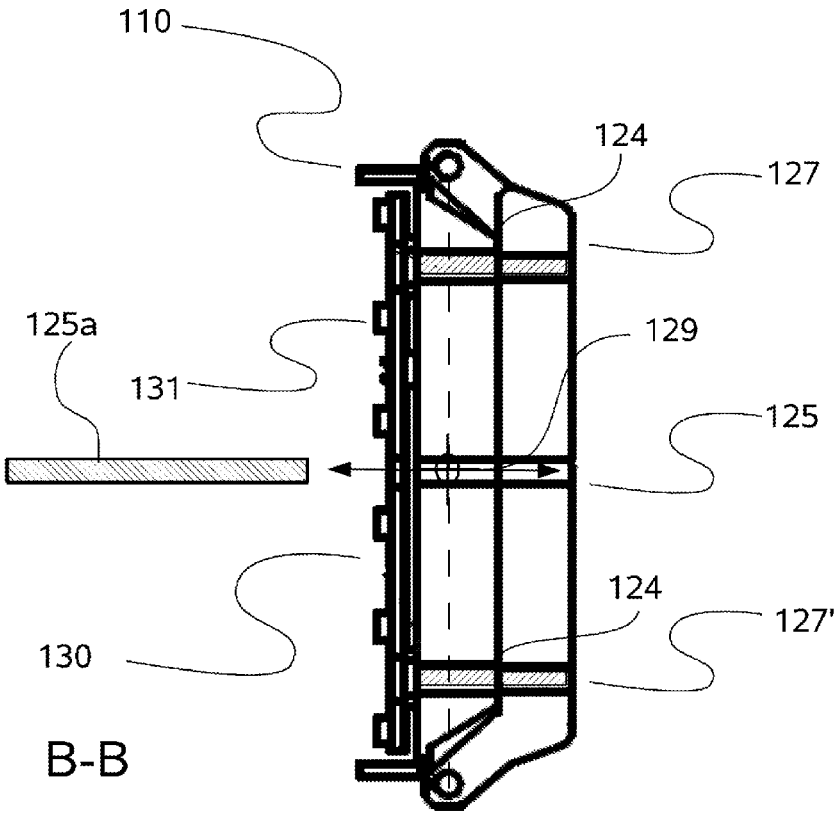
FIG. 14 is a cross-sectional elevations of the portion of the display of FIGS. 23A and 23B, taken at the position B-B in FIG. 15

Further, once the LED boards 130 are aligned on the blade they are preferably attached to it with screw 124 or rivets 128 via additional sets of holes 127 that are disposed in this embodiment in pairs of which one 127 is above the alignment hole 125 and the other 127' just below it. As shown in FIG. 14, it is also desirable to attach the blades 110 and LED boards 130 to the hinge pairs 120 and 120' using the same common sets of holes 127, but with screws 124 rather than rivets 128. This enables the removal of the blade assembly 114 (which includes the blades 110, attached LED boards 130 and connectors 140 and 150 from the hinges 120 and 120' from the front of the display 100 for repair and maintenance. Accordingly, it is also preferred that wire segment 501*a* in FIG. 16 also have a plug and socket connection to the wire harness 500. As also shown in a more preferred embodiment in FIG. 30, such a connector 140 may be is attached through an hole or orifice 137 in the hinge plate 121 and is part of a signal-power distribution module 160 which is attached to the rear of the hinge plate. so that a replacement blade assembly 114, with the LED boards 130, 130' and 130" and all active components be replaced when maintenance personal do not have the time or skill necessary to trouble shoot the cause of failure once the blade assembly 114 is removed from hinges 120 and 120'. Wiring harness 500 is preferably a flat cable to minimize the space required being display 100 when installed on a wall.

Thus, in the assembly of multiple blades 110 into a column 119 and 119', the upper 121 and lower shackles 122 of hinge 120 are capable of forming an axial rotary connection with the other member on each vertically adjacent hinge 120' and 120" when connected by the shackle pins 126.

Figure 23:
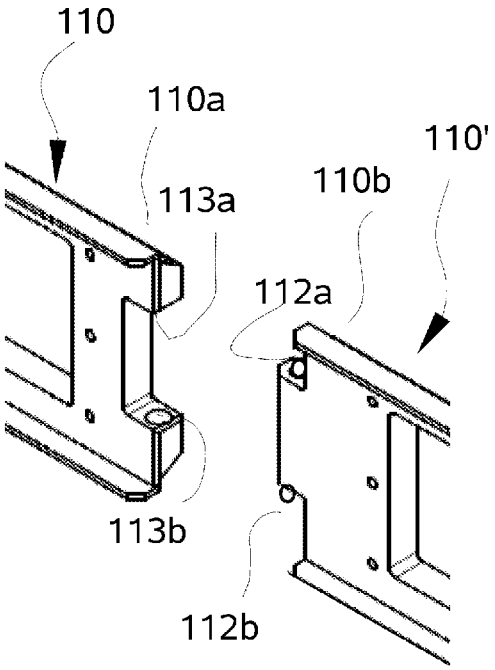
FIG. 23 is a front perspective view of adjoining portion of adjacent blades in FIG. 12A prior to attachment to form a larger display.
Figure 24:
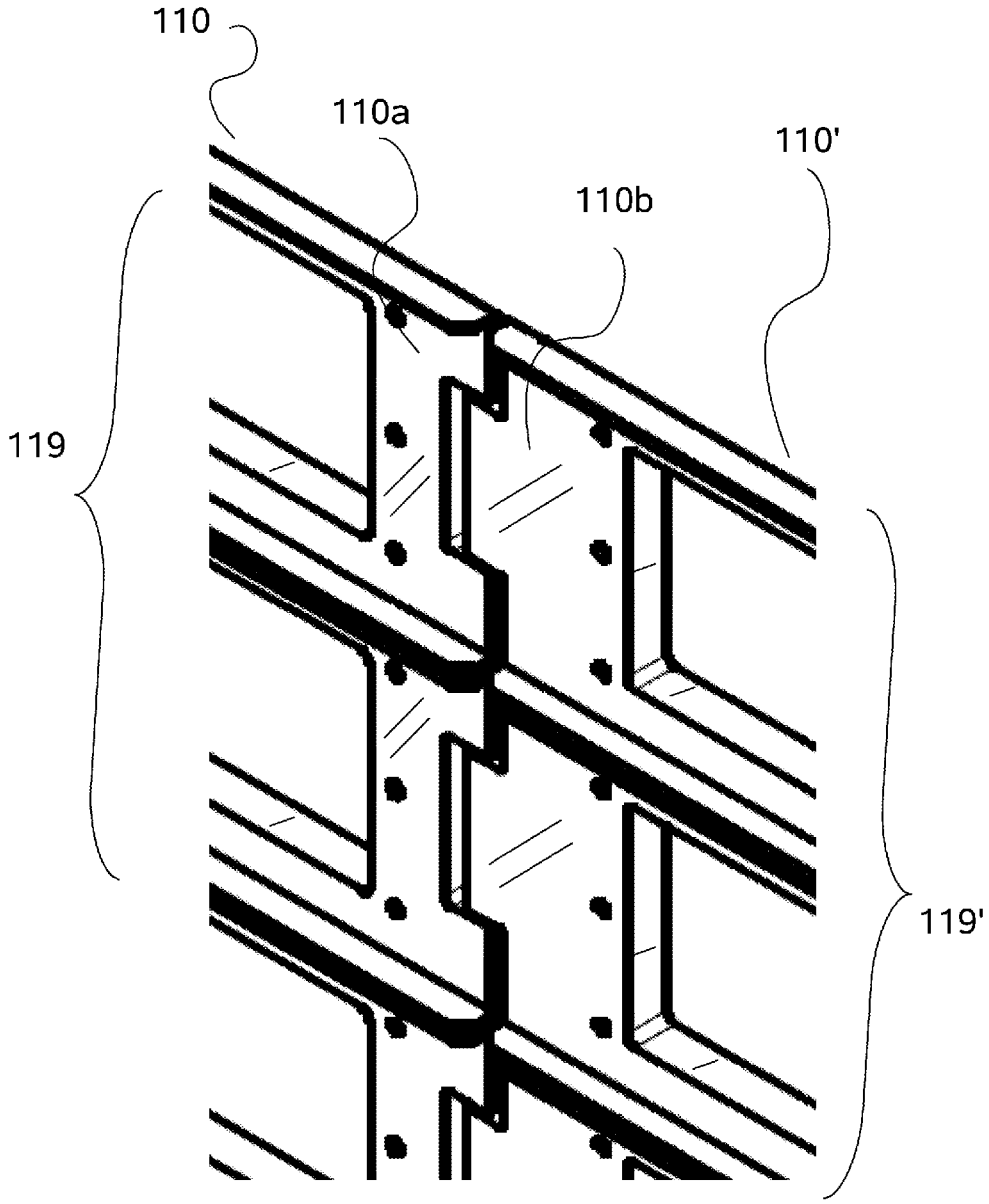
FIG. 24 is a front perspective view of adjoining portion of several adjacent blades in FIG. 12A after attachment to form the larger display.

It should now be appreciated that multiple horizontal array of the display columns of one blade 110 wide can coupled to form a display 100 of any width, whenever additional blades 110 can be added to each column to extend the length or height of the display 100. Thus to enable the lateral connection of blades 110 in these adjacent columns, it is preferable that the horizontally oriented elongated members/blades 110 has mating edge connectors 110*a* and 110*b* at opposite horizontal ends. The extending mail member 110*b* is intended to fit within female mating member 110*a* at the opposite side of the adjacent blade, forming the connection shown in FIG. 24. More preferably, as shown in FIG. 23 the mating edge connector 110*b* is connected to 110*b* via ball and socket type joints in which balls 112*a* and 112*b* on opposite horizontal portions of edge connector 110*b* are spring loaded and thus capable of engaging in mated attachment to a corresponding complimentary shaped sockets 113*a* and 113*b* on the other edge connector, 110*a*.

LED display boards 130 have a plurality of pixels 32 defined by 3 or more LED's 131 of different colors and include a plurality of integrated circuits and electrical conductor traces for properly routing signals and electrical power to each specific LED to control the color and brightness in time synchronization to project video images for direct viewing by users or an audience.

Figure 16:
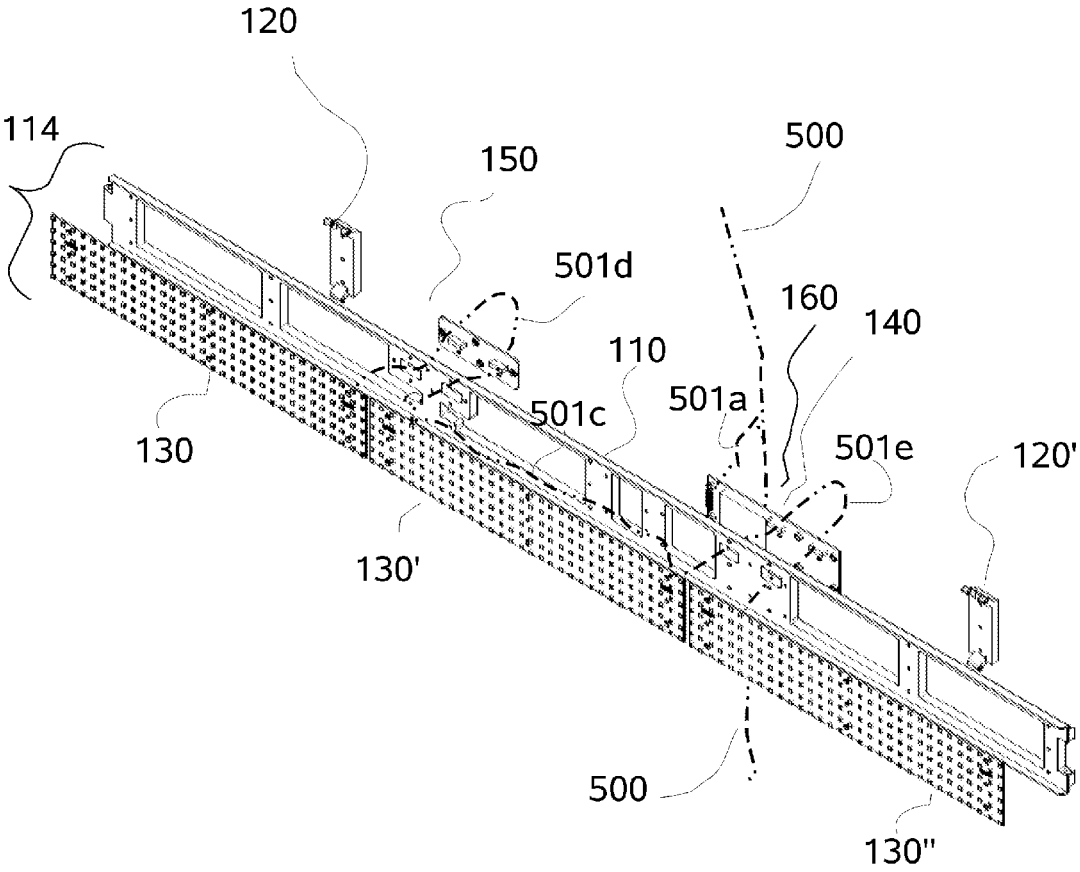
FIG. 16 is an enlarged portion of the exploded view in FIG. 12B.

FIG. 16 illustrates a first embodiment of the internal wiring of the multiple LED's on a single blade 110 wherein signal and power is distributed to the vertically array blade assemblies 114 on an electrical bus wiring bundle or cable 500. Power and signal is distributed from bus 500 to the LED boards 130, 130' and 130" via a wire or circuit segment path 501*a* to the power and signal connector 140 and power distribution board 160 on each blade assembly 114. Power and signal connector 140 joins LED boards 130' and 130" via wire segment path segment 501*e* to route signal and power in response to the operation of the power distribution board in decoding the video signal received from bus 500. LED board 130' routes signal and power via wiring path segment 501C to the LED connectors 150, which is then connected to LED board 130 via segment 501*d*. Each wiring path is intended to carry power and signals to the plurality of LED's. The LED boards 130 each have additional signal routing means via attached integrated circuits 134. A wiring path as described above can include pair of parallel conductive traces or wires were the power and signals are separate, or a single line in which the signals are multiplexed on the power supply.

Preferably both the display 100 and the connected components are water proof for use in adverse weather, using conventional weather proofing means, such as gaskets at connects and sealing or conformal coating on all wiring boards, overmolding, encapsulation, such as with Macromelt® and the like.

Figures 25A, 25B:
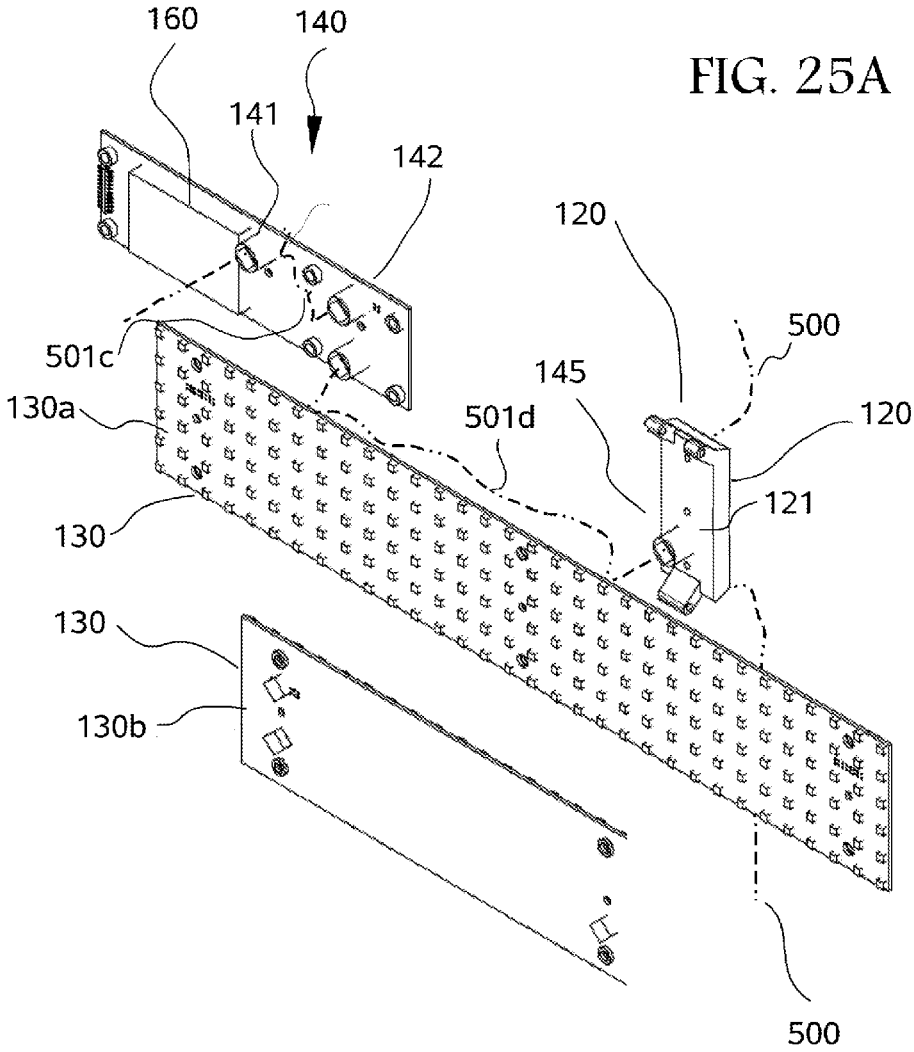

In the more preferred embodiment shown in FIGS. 25A and 25B, the bus 500 is connected to power and signal controller 140, and hence power distribution board 160 via hinge 120. Hinge 120 has a multi-pin connector 145 that is disposed in a gap in hinge plate and extends from the hinge plate 121 to connect to the LED board 130 at the mating plug on side 130*b*, FIG. 25B. The opposite side of the hinge 120 from connector 145 has either wiring terminals or another plug or socket to connect with the bus 500 wiring. connectors. Thus, as LED board 130 is connected to bus 500, circuit path 501*d* on this LED board 130 connects to the power and signal controller 140, as in the embodiment shown in FIG. 16-18 provides power and signals to the other LED boards 130' and 130". It should be appreciated that when the hinge 120 is used to connect the bus 500 to the blade assembly components, the active components, such as power distribution board 160 can be disposed in different locations on the blade 110, as well as combined with the hinge, and need not be limited to the preferred embodiments described herein.

Figure 26:
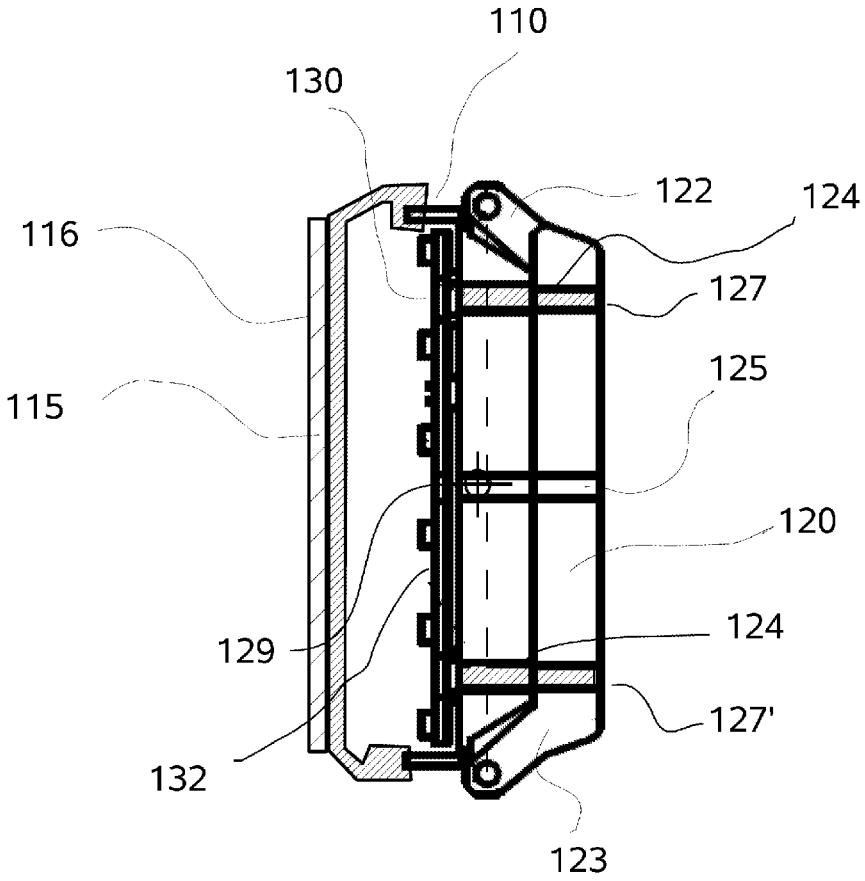
FIG. 26 is a side elevation through a portion of the display wherein the LED board is protected by a cover.
Figure 27:
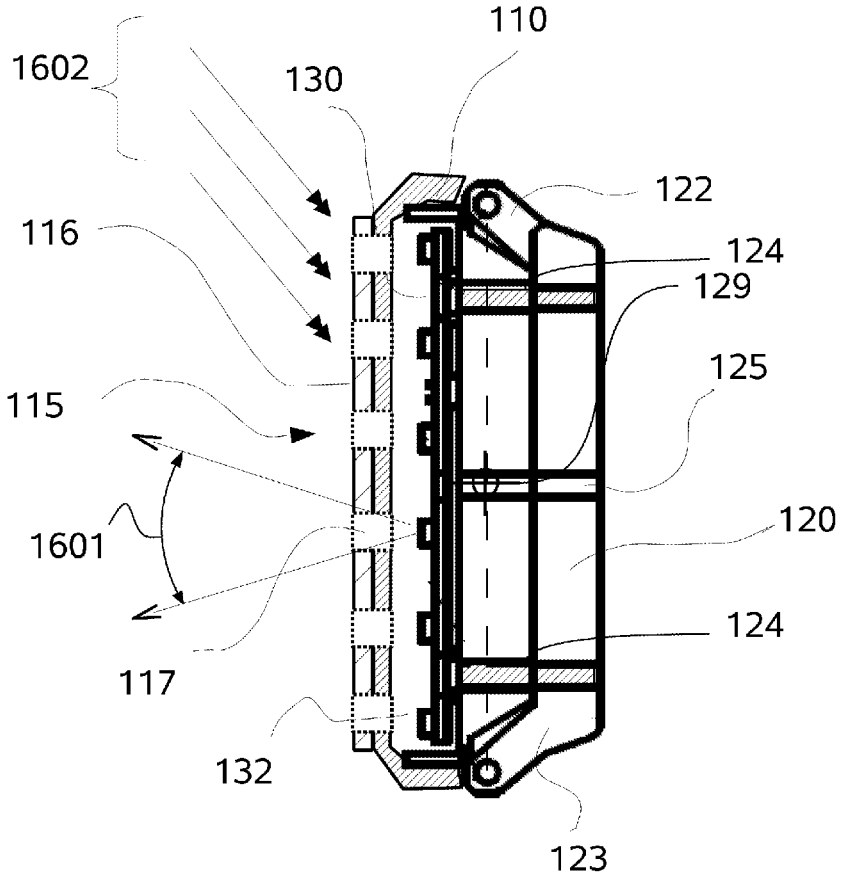
FIG. 27 is a preferred embodiment of the cover shown in FIG. 26.

In more preferred embodiments there is a protective cover 115 over each horizontal rigid member. As shown in FIG. 26, a protective cover 115 is disposed over the LED board 130. The protective cover is optionally transparent, and the front 1 of the LED board 130 around each of the LED's has a non-reflective black color. Alternatively, the protective cover 115 can be black and opaque, but have holes 117 cut out for each of the LED's 131 as shown in FIG. 27. The cone of light emitted by each LED 131 is represented by the arrows and arc 1602. The holes 117 have a sufficient diameter, based spacing from the LED's 131 to avoid shadowing the LED emission.

While in this embodiment the cover is separate from the leaf board 131, it is more preferred that the cover is molded directly onto the leaf board.

More preferably either embodiment of the protective cover 115 also includes a means for thermal control to minimize solar heating of the outdoor display. In FIG. 27, thermal radiation, such as from the afternoon sun is represented by parallel rays 1601, and would ordinary heat the display 100 via IR radiation, as well as reflect visible light back to viewers. One embodiment of a thermal control means 116 is illustrated in as a multi-layer thin film coating, referred to as a hot mirror, is capable of reflecting infra-red radiation from the sun, but is transparent and transmits visible light so that it is absorbed by the black colored portion 132 of the LED board 130 around the LEDs 131. The coating or black non-reflective portion preferably absorbs visible light so the rays 1602 are not reflected to viewers off the cover 115. Reflection of visible light to the viewers would otherwise minimize display contrast or require higher LED brightness in some viewing conditions. Such a coating may additionally block UV light to protect the underlying materials that form the display.

The substrate for the protective cover that support the thermal control means is optionally fully clear transparent or optionally somewhat translucent to diffuse the light.

Such thermal control multi-layer coatings are described in U.S. Pat. No. 6,391,400, which issued to Russell et al. on May 21, 2002, as well as U.S. Pat. No. 5,306,547, which issued to Hood on Apr. 26, 1994, both of which are incorporated herein by reference.

Figure 28:
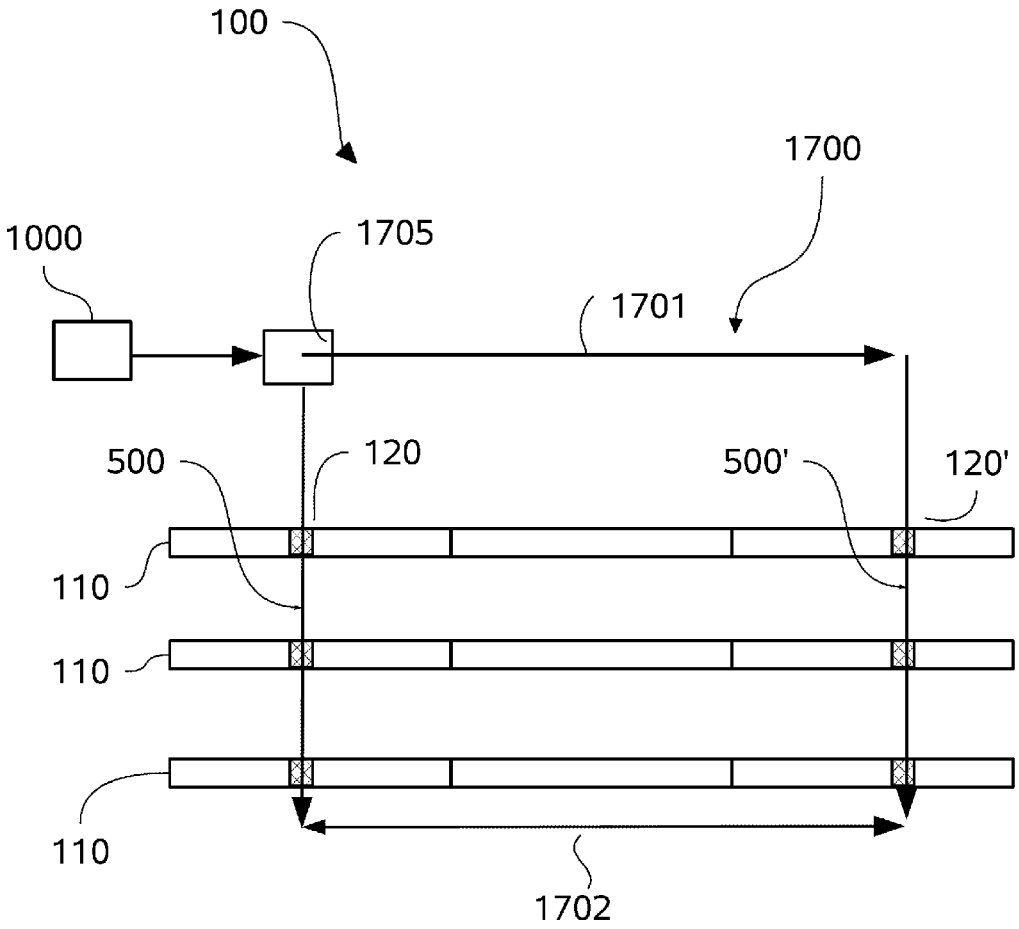
FIG. 28 is an electrical schematic for signal distribution and routing via alternative buses.

In another preferred embodiment, shown as an electrical schematic in FIG. 28, the first set of vertically arrayed hinges 120 provides the wiring connections for a primary bus circuit 500, which receives signal and power from a video source 1000, via a switching circuit 1700. A second set of vertically arrayed hinges 120', comprising the adjacent hinges 120' on the vertical arrays of blades, provides a secondary or back up bus circuit 500', should the bus circuit 500' prove defective or fail. Once this failure is determined from circuit integrity testing the communication and operation of the display 100 can be switched to this back up bus circuit 500' via a switching circuit 1705, that then directs power via circuit segment 1701. In this case, the same power and signal can be routed either way on segment 1702, such that segments 1701 and 1702, together with the primary and secondary bus circuits 500 and 500' respectively form a circuit integrity loop 1700.

It should be appreciates that as the display 100 is intended for outdoor use, it is most preferable that all electrical connections and components are water proof, such as for example by gasket at each plug and socket connection, as well as by the sealing of printed circuit boards in the LED board 130 and the power and signal module/controller 140 via conformal coatings and related means known in the art.

It should be appreciated that the hinges 120 and hinge shackles 122, 123 can have different configurations than those shown and still achieve the same functions of connecting adjacent blades 110 and permitting at least a limited amount of rotation at adjacent sides to enable the rolling and unrolling thereof for storage and use respectively. Such options include, without limitation a traditional "lift-off" hinge where the two halves of the hinge slide apart in the axis of the hinge pin. Once assembled, the "lift off portions" can be further coupled to preclude sliding out during employment during deployment, as for example by permanent fixation or via a removable member. Alternatively, the hinge (or at least a part thereof) could be integrally formed with a molded or extruded member that forms the blade, rather than a separate discrete component.

Further, it should be appreciated that more than 3 or 4 LED's can be used to create pixel, depending on the LED luminance, color purity and the sensitivity of the human eye. Moreover, the LED's 131 can be arranged in other patterns than a square grid. Thus, neither the number of pixels per LED board 130 or per pixel 32 need be limited to what is shown in the FIG's.

FIG. 29 illustrates a more preferred aspect of the invention wherein the rolled display is disposed within an elongated truss support 2901 and deployable therefrom. Such a truss or support frame 2901 will have 3 or 4 elongated main post 2902 shown as extending horizontally that are connected at the ends series of shorter posts 2903 that form a closed figures, such as the square shown in this Figure. Preferably depending on the length of the posts and their stiffness, it is also desirable to connect the posts with 1 or more cross beams 2904 on the open sides of the truss 2901. The cross beams connect elongated posts 2902 and extend either transverse or at an angle thereto providing further stiffness to the truss 2901. The axle 10 extended with the same orientation as the main post 2902 and the motor for rotating the axle 10 is preferably disposed within the truss 2901. The truss 2901 also has one open side 2905, or at least a part thereof that is the width of the display 100 so that it can be unrolled there from by turning the axle 10 with the motor 803. The open side 2905 is defined by the area between the two pairs of opposing short posts 2903 and the adjacent pair of opposing posts 2902 at the lower side of the truss 2901.

Figure 10:
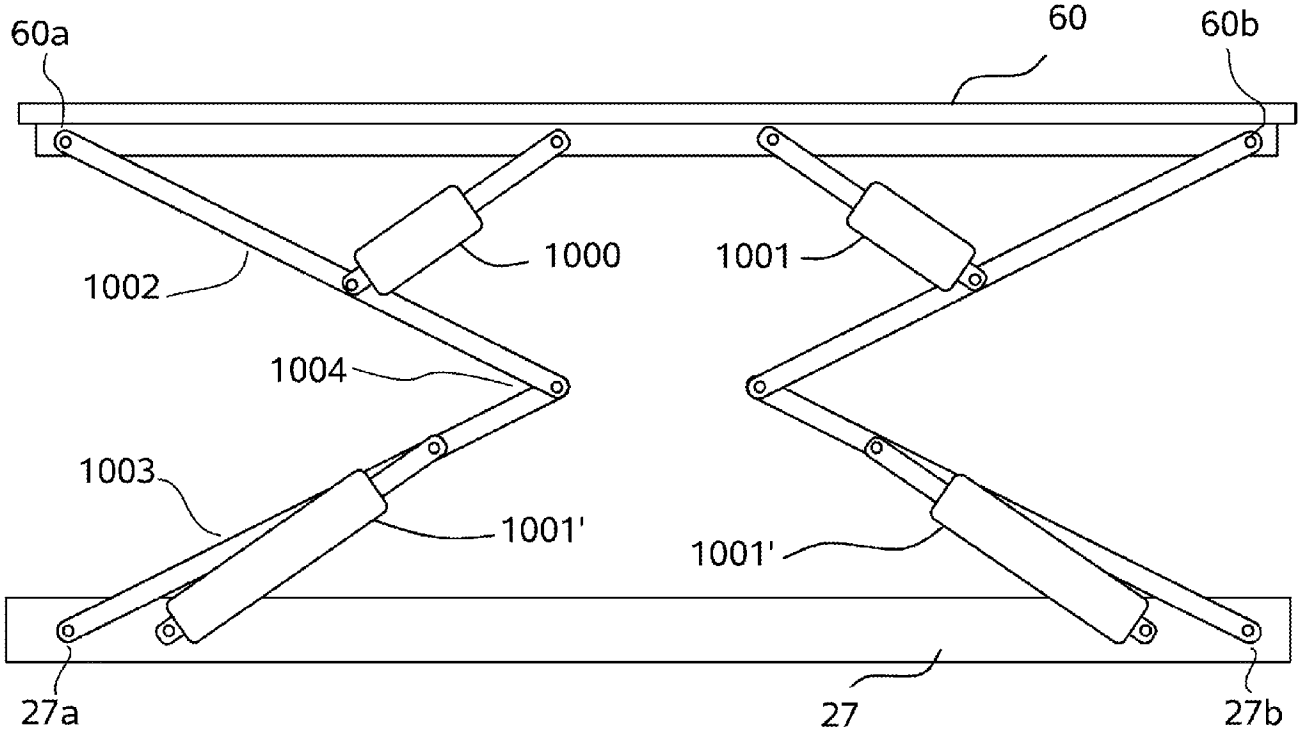
FIG. 10 is a more detailed view of the lifting mechanism in FIG. 9.

The truss 2901, like the canister 21 can be mounted on a trailer so the display can be raised upward from open side 2905, which would then face upward from the truck or trailer bed, such as by using the lift mechanism shown in FIG. 10. Alternatively, the truss 2901 can be mounted above the ground for lowering the display downward, such as from similar trusses, or on a wall. Alternatively the truss 2910 can be placed in hinged attachment at or adjacent to one of the short posts 2903 on the trailer bed for tilting upward so that the posts 2902 are vertical and the display can be extended horizontally on the truss 2901 is braced in this upright position. It should be understood that the first row 2906 of hinged components to extend from the display 100 need not include the LED boards 130, but can be simply for attachment to the pulling mechanism or when the display 100 is lowered to floor, ground or truck, trailer bed for attachment to an anchor mechanism mounted thereon.

Figure 30:
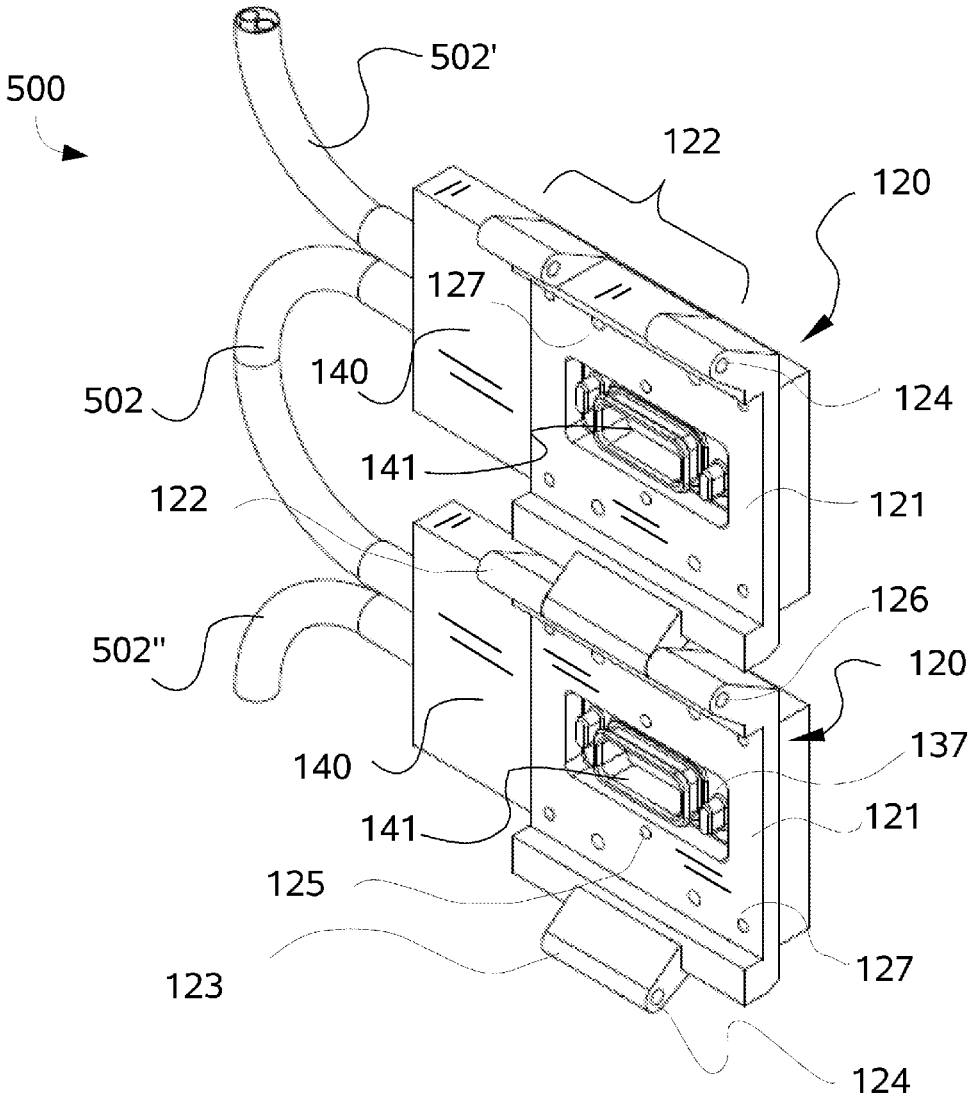
FIG. 30 is a perspective view of connected hinges with attached power and signal cable and associated connector.

FIG. 30 illustrates in more detail a preferred mating hinge 120 for use with an embodiment of the signal-power distribution module 140. When hinges 120 are used to connect what is preferably a tiled array of the rectangular elongated blade supporting multiple electronic display boards 114, the hinge 120 can support both the signal-power distribution module 140 and the elongated blades 110 which are coupled thereto via what is preferably a releasable engagement via screw or comparable mounts that are accessible from the LED side of the display surface of LED board 130. In such case a mating connectors of the signal-power distribution module 140 and optionally the electronic display board 30 pass may pass through an orifice of hole 137 in the hinge 120.

Figure 31:
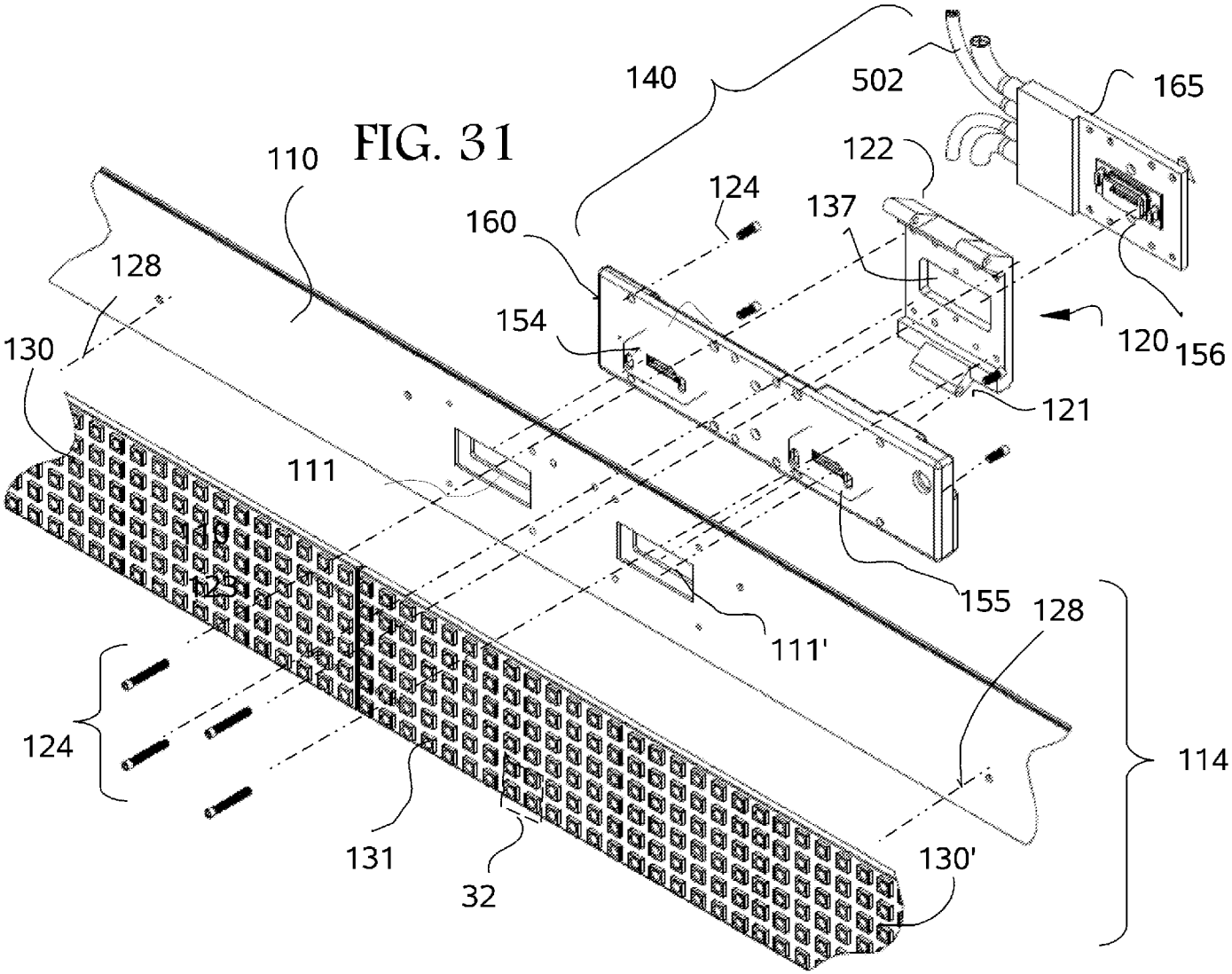
FIG. 31 illustrates in an exploded perspective view a preferred embodiment of connector and attached hinge in FIG. 30 showing the electrical and mechanical connections to the electronic display board.

More preferably, as shown in FIG. 31, the signal-power distribution module 140 includes power distribution board 160 that mounted to back of blade 110 and a bus connector 165 connects to the back of the power distribution 60 via hole or orifice 137 in hinge 120 via connector 156. Thus, the signal-power distribution module 140 is in electrical connection to LED boards 130' and 130" via plug and socket types connectors 141 and 142 that extend through blade 110, as shown in FIG. 17, via apertures 111. The bus or wiring harness 500 is now comprised of the series of looped at signal-power cables 502 and 502' extending from the connection with the signal-power module 140 and extending behind each elongated blade 110.

While is preferable that a single chain of cables 502 have within them separate signal and power cables, the wiring harness or bus 500 can also include 2 pairs of such signal-power cables 502, such as one carrying only signal and the other one carrying only power.

The mating hinge has at least one aperture 137 for receiving a connector 150 attached or coupled to at least a portion of the signal-power distribution module 140, such as the connector 151 on power distribution board 160. This use of this connector 120 with an elongated blade 110 and LED display boards 130 is illustrated FIG. 31-37.

In this embodiment the electronic display 100 is formed from at least one substantially rectangular elongated blade 110 having a first height and a first width, a front and a rear surface, opposing lateral side that are separated by opposing horizontal sides at the top and bottom thereof. A plurality of elongated display boards 130 having a second height and second width, a front and a rear surface, opposing lateral side that are separated by opposing horizontal sides at the top and bottom thereof are mounted on the each rectangular elongated blade as previously described. Each elongated display board 130 has an LED array arranged as a plurality of display pixels 32 on the front surface thereof. Each elongated display board 130 has a first terminal connector 141 on the rear surface for distributing at least one of signals and power to the LED's of the LED array.

Figure 33:
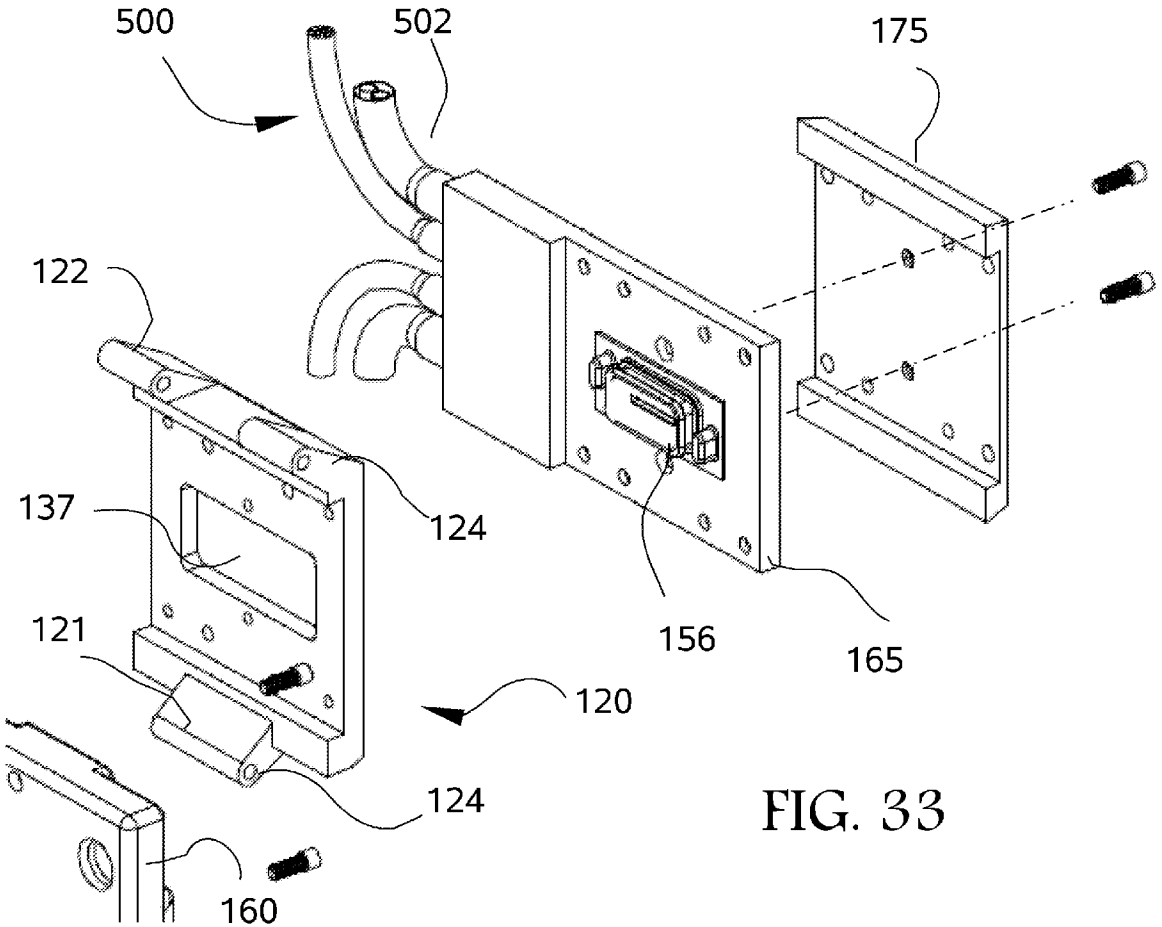
FIG. 33 is another exploded perspective view of a portion of FIG. 31 to show an additional component.

FIGS. 31 and 33 illustrate in perspective view a preferred embodiment of a signal-power distribution module 140 and associated connectors that can be used with or without hinged or cable connection between elongated blades 110 that support the LED display boards 130.

Figure 32:
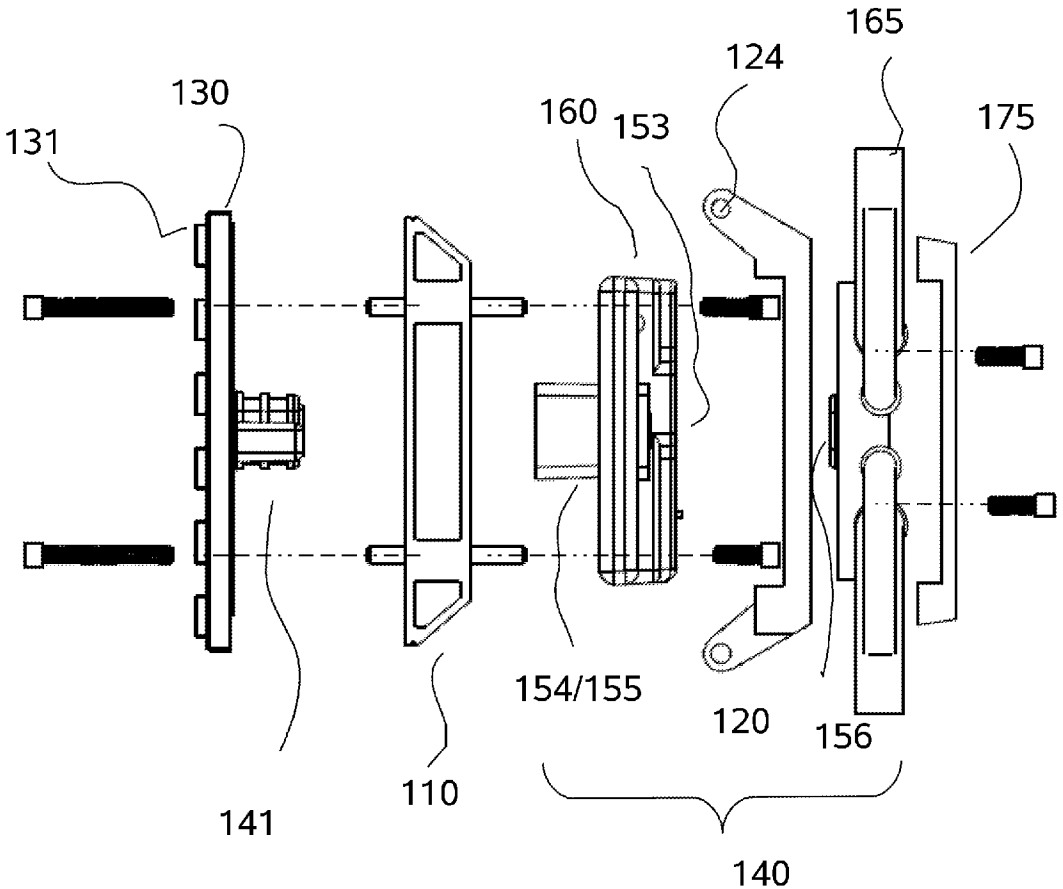
FIG. 32 illustrates in a an exploded cross-sectional elevation view of the preferred embodiment of the connector of FIG. 31 deployed with hinged or cable connections between elongated blades that support the LED display boards.

FIG. 32 illustrates in an exploded cross-section elevation view of a preferred embodiment of the signal-power distribution module 140 and associated connectors. This version of the signal-power connector 140 is assembled from multiple components for ease of disassembly, repair and rework from the LED side of the display 100. In this case it is preferable that the power distribution board 160 includes an interface controller that has the active circuitry and connects via a single rear connector 153 to the bus connector 165 at connector 156. The power distribution board/interface controller 160 has two front connectors 154 and 155. The interface controller 160 thus routes and modulates at least one of signals and power via active circuitry to the individual pins or sockets in each of connectors 154 and 155 into the common pins or sockets of rear connector 153. The rear connector 153 passes through the single aperture 137 in the hinge 120 so that the interface controller 160 is disposed between the hinge 120 and the elongated blade 110. The elongated blade 110 in turn has two separate aperture 111 and 111' that respectively receive the front connectors 154 and 155, which pass there through to connect with the rear connectors 141 and 141' on the back of the adjacently tiled LED boards 130 and 130'. The interface controller 160 is fastened to the blade 110 via rear screws 124' so that the removal of front screws 124 disconnects assembly 114 from the hinge 120 and the bus connector 165. The rear connector 153 of the interface controller 160 connects to the front connector on the bus connector 165. The bus connector 165 has a plurality of external cables 151 connecting at least the near neighbor blade assembly 114 in the display column via there respective bus connectors 165. Optionally, as shown in FIG. 33 and the bus connector 165 is connected to the hinge 120 via an end cap plate 175.

Figure 34B:
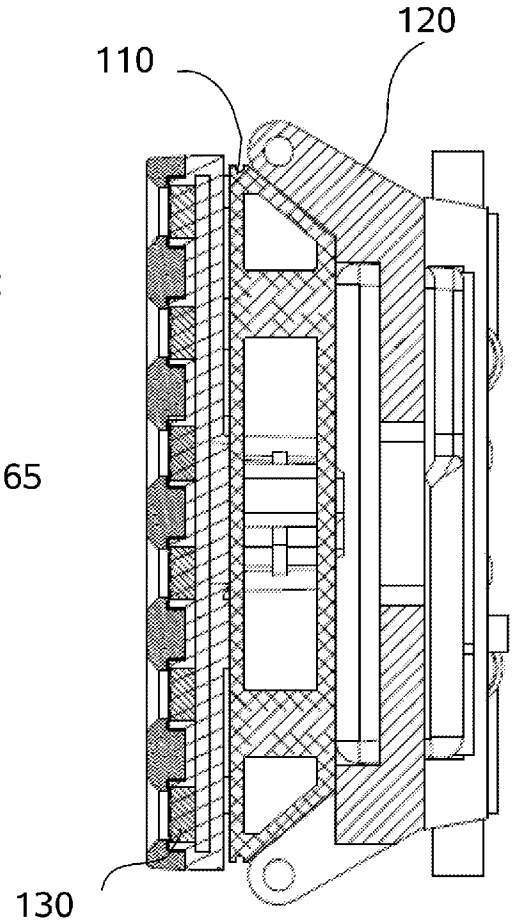
FIGS. 34A and 34B are cross-sectional elevation through portion of the display in FIG. 31-33 with FIG. 34A being adjacent to the hinge but through the signal-power module only and FIG. 34B being through the hinge.
Figure 34A:
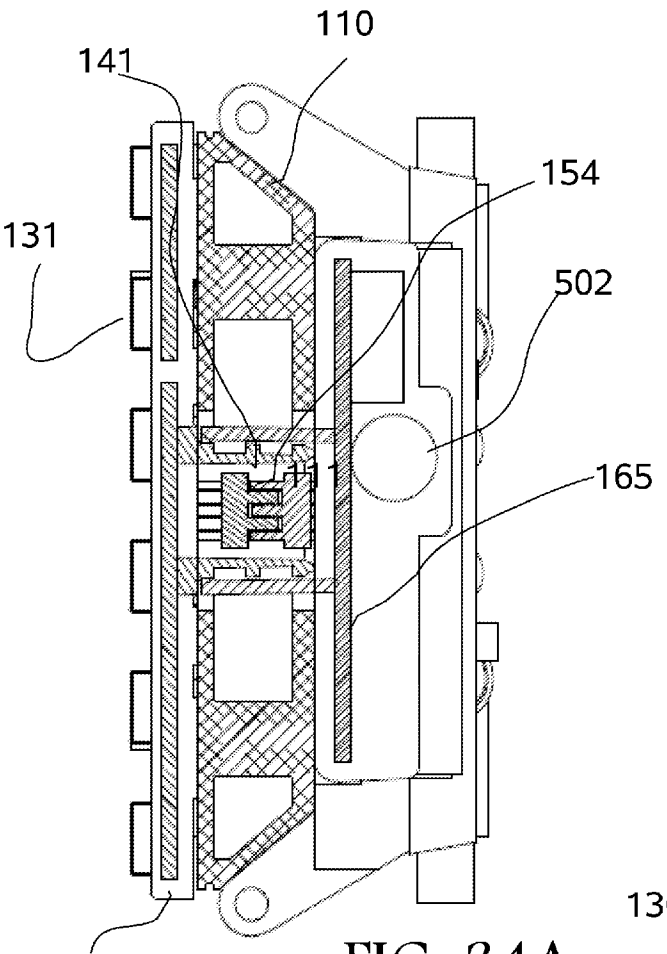

FIGS. 34A and 34B are cross-sectional elevation through portion of the display 100 in FIG. 31-33 with FIG. 24A being adjacent to the hinge but through the signal-power module only and FIG. 34B being through the hinge.

Figure 35A:
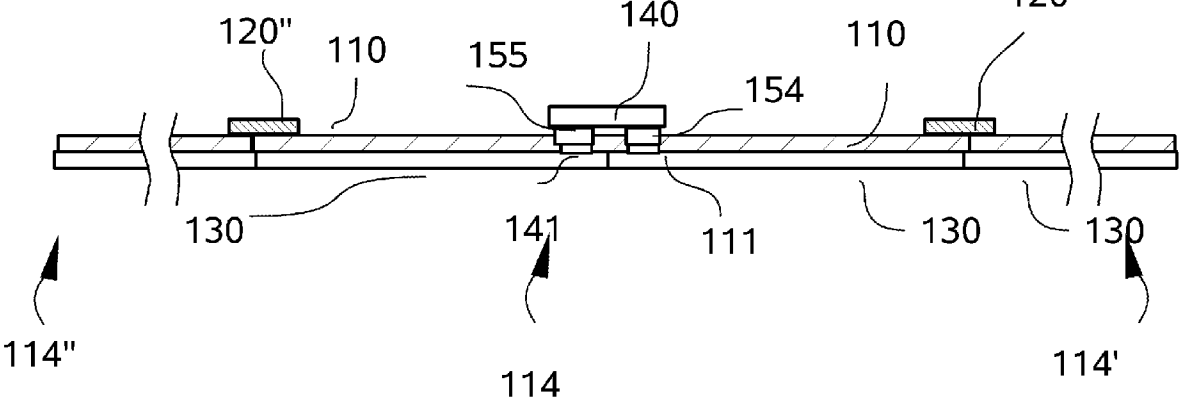
FIG. 35 are plan views of a single and multiple blade assemblies showing various the connector of FIG. 30-34 as deployed in various means for connecting the multiple blades to assemble the electronic display.
Figure 35B:
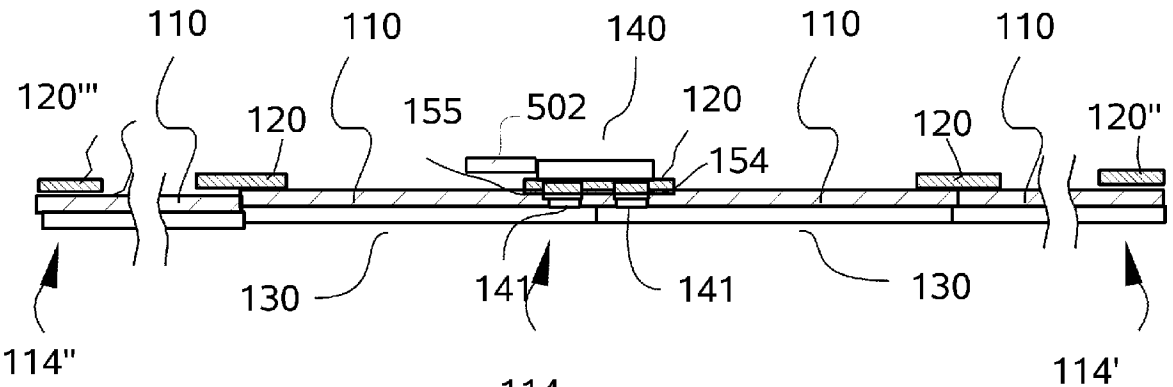

It is further preferable that each electronic display board 130 is about the same height of the blade 110 and about half the width so that one blade supports two electronic display boards 130. FIG. 35 are plan views of a single and multiple blade assemblies of two LED boards each showing the various connectors of FIG. 30-34 as deployed in multiple blades to assemble the electronic display. In FIG. 35A blade assemblies 114 and 114' are connected at the vertical edges by hinge 120', and blade assemblies 114 and 114''' are connected at the vertical edges by hinge 120''.

In FIG. 35A blade assemblies 114'' and 114' are each connected at the opposite vertical edges of the display 110 to the horizontally adjacent blade assemblies disposed above and below by hinge 120''' and 120'' respectively.

Figure 36A:
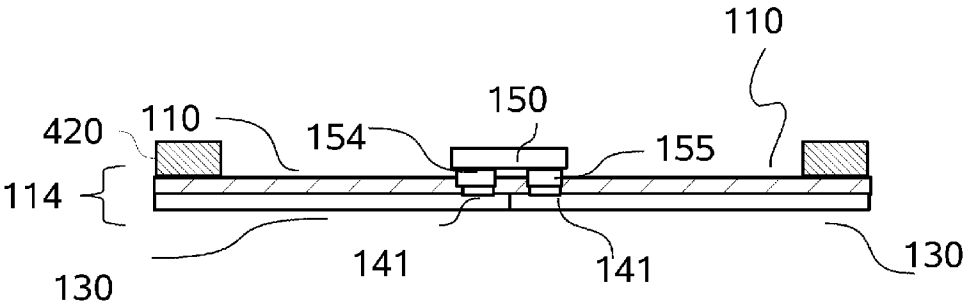
FIGS. 36A and 36B are plan views of a single and multiple blade assemblies showing various the connector of FIG. 30-34 as deployed in various means for connecting the multiple blades to assemble the electronic display.
Figure 36B:
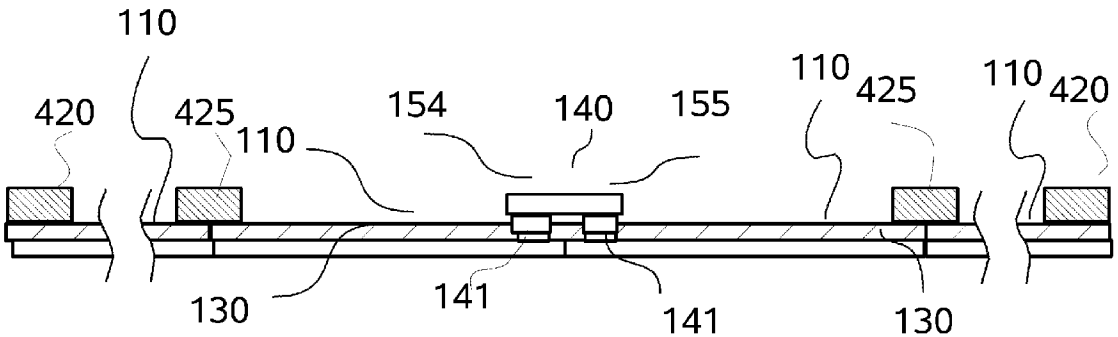

In FIG. 36A a single column of elongated blade assemblies 114 are mounted in tiled fashion to a larger frame. In FIG. 36B a plurality of assembly 114 are mounted in tiled fashion to a larger frame 420 having intermediate vertical struts 425. A perspective view of such a display 100 in shown in FIG. 33 in which the assembly 114 on the left side is exploded to show the components in FIG. 31C, and the right side is completed assembly except for the lower assembly 114 showing the LED side only.

Figure 37:
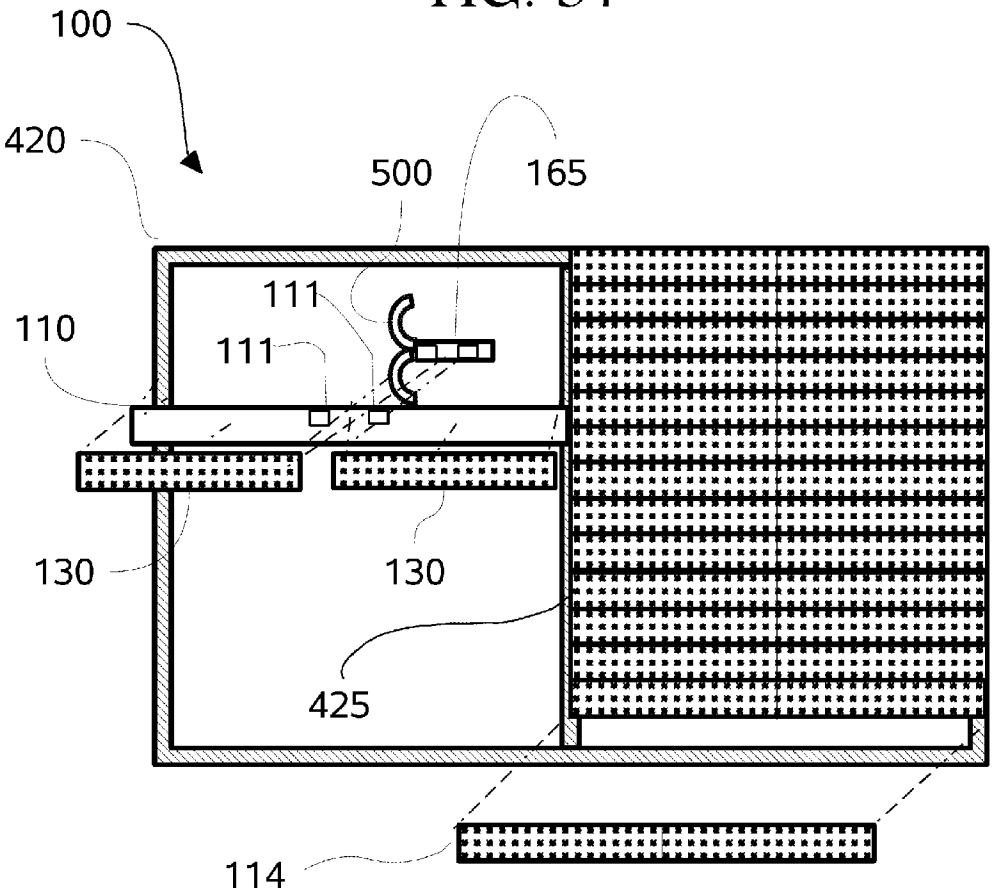
FIG. 37 is an exploded perspective view to illustrate another embodiment of the invention in which elongated blades supporting the LED display boards are tiled together on a rigid frame.

FIG. 36B mounted to hinges 120 that connect the vertical sides of adjacent tiled assemblies 114 in the display 100.

it should be appreciated that signal-power distribution module 140 has at least one terminal connector on the front for mating engagement with the first terminal connector on the back of at least one of the elongated display boards 130 wherein at least one of a first and second signal-power connectors 151 and 152 optionally pass through the at least one elongated blade 110 to the engage the other of the first and second power connectors of the LED boards, FIGS. 36A and 36B are plan views of a single and multiple blade assemblies which illustrated the attachment of the blade assembly to a supporting rectangular frame 420 without the use of hinges. The frame 420 can support multiple columns of elongated blades, shown in this diagram as each blade supporting a pair of LED display board 130. The lateral sides of the frame can have a series of threaded holes or straight holes to receive the opposing sides of the elongated blades 110. As also shown in FIGS. 36B and 37, when 2 or more column of elongated blades are connected or coupled to frame 420 it is preferable to provide a least one vertical strut 425 that similarly has a array of holes for receiving the elongated blades 110. This diagram also shows one of the signal-power distribution module 160.

Figure 38B:
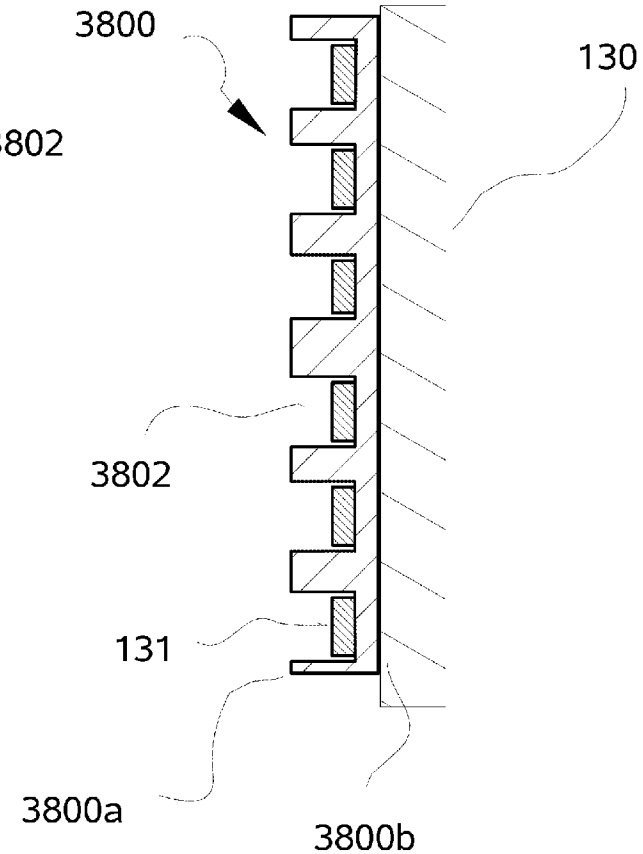
FIG. 38B is a cross-sectional elevation thereof as mounted on a display board.
Figure 38A:
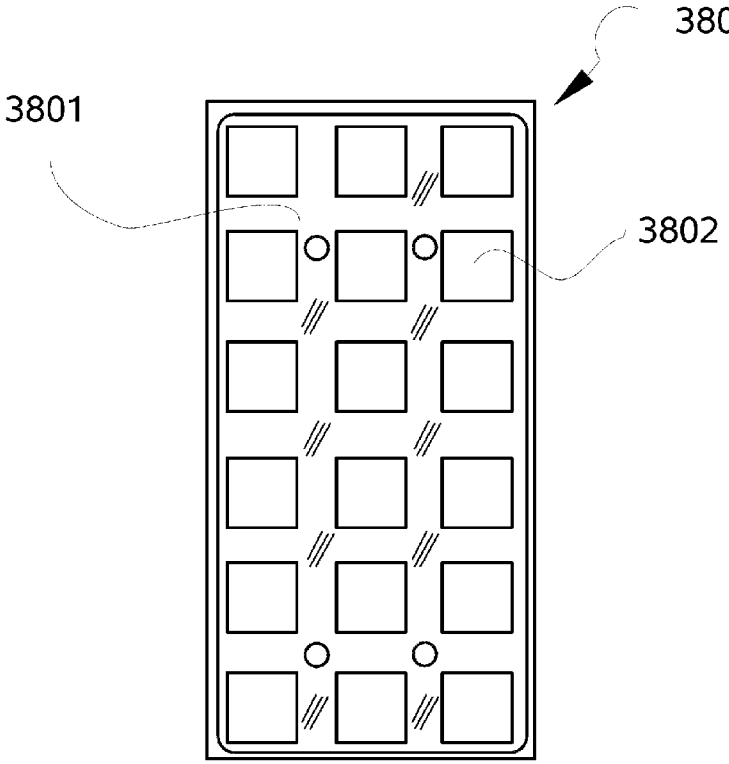
FIG. 38A is a front elevation view of a protective cover or wear block.

FIG. 38A is a front elevation view of a protective cover 3800 that is preferably applied over some subset of the display boards 130 to protect the LED's 131 arrayed thereof. The front face 3800*a* of cover 3800 extends above the LED's 131 as shown in the sectional elevation in FIG. 38B. The LED's 131 are disposed in the square apertures 3802 formed in cover 3800, which is secured to the display board 130 via screws or like fastening members inserted through circular holes 3801 that extend from the from face 3800*a* to the rear face 3800*b*. As the cover 3800 is preferably made of a durable yet non-abrasive plastic or polymeric material it does not damage other display 100 components, but rather protects them as it is intended to be placed at the same regular lateral intervals along the front of the display 100 as the hinges 120 that have the cap plate 174 are attached to or form the back of the display. Hence, when the display 100 is rolled up as illustrated in other embodiments the hinge cap 175 and protective covers 3800 made contact spacing the front and back side of the elongated blades 100 and the electronic components attached thereto away from each other to prevent contact and potential damage from contact abrasion.

Thus it is most preferable to dispose protective cover 3800 to straddle the adjacent elongated blades 110 at common connecting hinge 120. Likewise, the generally U-shaped end cap plate 175 shown in FIG. 33 is connected to the rear surface of each corresponding hinge 120. Thus when the flexible display is rolled up for storage and transport, non-adjacent blades in the roll, that is nearest neighbor blades in a different wrap of the roll and not connected by common hinges 120 are separated by the front and rear space, which contact each other. Most preferably, protective cover 3800 and end cap 475 should be used at each hinge 120.

Figure 39:
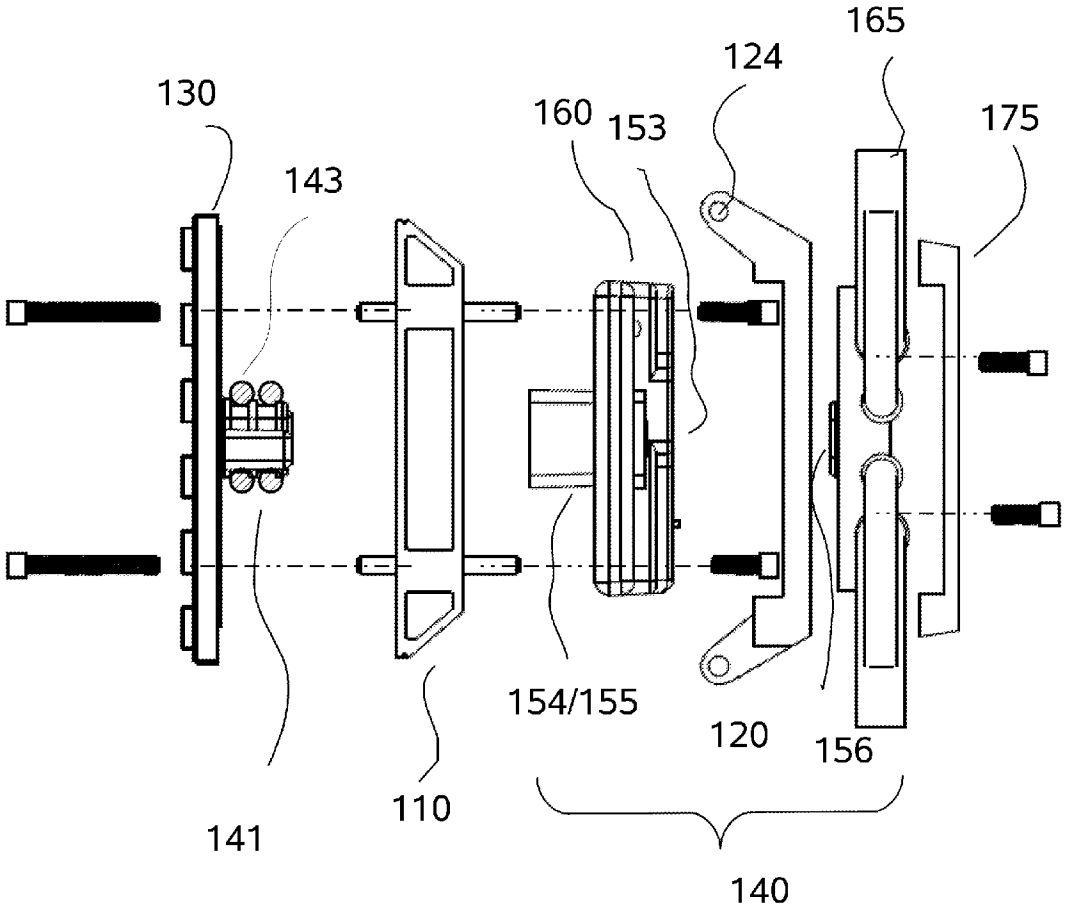
FIG. 39 illustrates in a an exploded cross-section elevation view of a more preferred embodiment of the connector of FIG. 30 that deploys gaskets and is further deployed with hinged or cable connections between elongated blades that support the LED display boards.
Figure 40B:
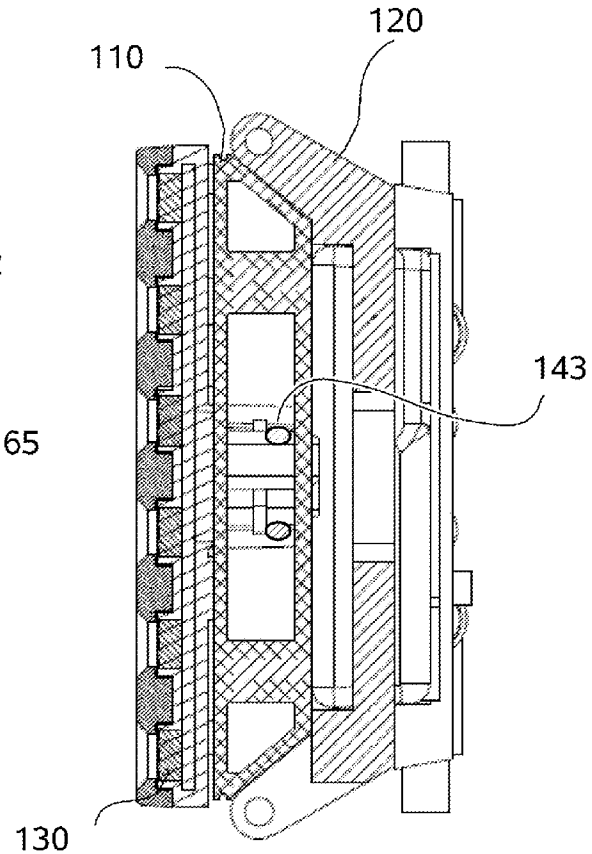
FIG. 40A and FIG. 40B respectively illustrate more preferred embodiments of connectors that deploy gaskets as cross-sectional elevations through portion of the display in FIG. 31-33 with FIG. 40A being adjacent to the hinge but through the signal-power module only and FIG. 40B being through the hinge.
Figure 40A:
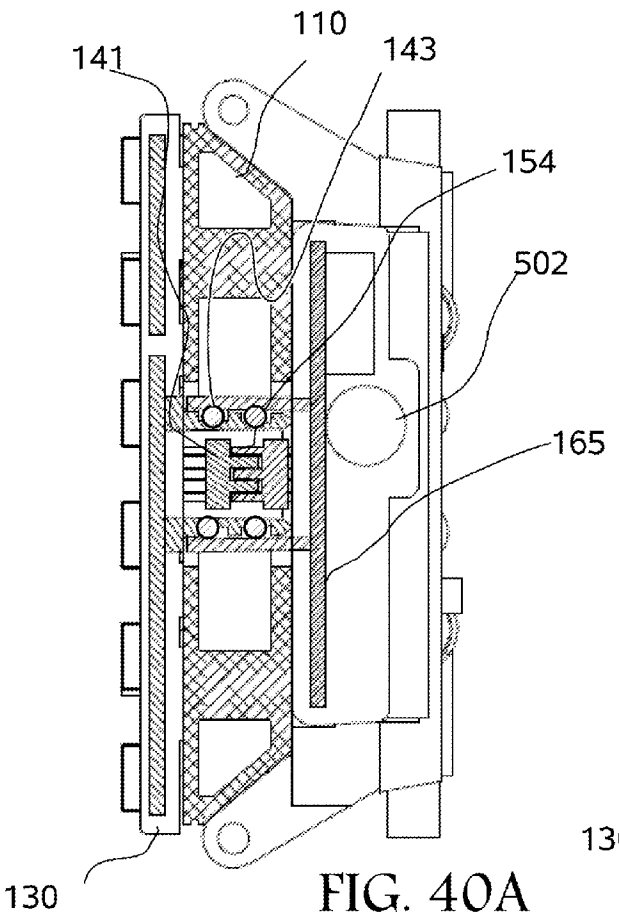

Further, it is preferable that the various connectors utilize flexible gaskets, as shown in FIG. 39, FIG. 40A and FIG. 40B to enable sealing from the moisture and the elements, including liquid water when used outdoors or in otherwise wet environments. Gaskets 143 can be used as adjacent pairs that disposed in notches or channels associated with the different mating connector pairs, such as rear connector 141 on the elongated display boards 130 and the front connectors 154 and 155 on the power distribution board 160. Gaskets 143 can be used to seal the connection between the connector 156 of bus connector 165 and rear power connector 153 on the power distribution board 160.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

We claim:

1. An electronic display comprising:

a) at least one substantially rectangular elongated blade having a first and a first width, a front and a rear surface, opposing lateral side that are separated by opposing horizontal sides at the top and bottom thereof, and;

i) a plurality of elongated display boards having a second height and second width, a front and a rear surface, opposing lateral side that are separated by opposing horizontal sides at the top and bottom thereof, and (1) an LED array arranged as a plurality of display pixels on the front surface of each elongated display board, (2) at least one rear terminal connector on the rear surface of each elongated display board for receiving at least one of signals and power that is routed to the LED's of the LED array, ii) means for signal and power routing and connection between adjacent elongated display boards in said plurality, iii) a signal-power distribution module having at least one front terminal connector on the front for mating engagement with the at least one rear terminal connector on the back of at least one of the elongated display boards, iv) at least one cable for providing at least one of signal and power to the LED's of each LED array via the signal-power distribution module that extends therefrom behind said at least one elongated blade.

2. An electronic display according to claim 1 wherein:

a) the second height is substantially the same as the first height, and b) the second width is less than about half the first width so that the at least one elongated blade can support at least 2 laterally adjacent elongated display boards.

3. An electronic display according to claim 1 further comprising at least a second elongated blade disposed above and vertically adjacent to the at least one elongated blade that is couples thereto in a tiled arrangement so that the spacing between the pixels at the horizontal edges of the vertically adjacent elongated blade is the same as the spacing between the pixels within each elongated blade.

4. An electronic display according to claim 3 wherein the respective signal-power cables of at least one elongated blade is attached to the signal-power distribution module of the vertically adjacent elongated blade.

5. An electronic display according to claim 4 wherein the at least one elongated blade is in hinged connection to the second elongated blade.

6. An electronic display according to claim 3 wherein the at least one elongated blade is in hinged connection to the second elongated blade via linked hinges, having at least one hinge disposed to support the signal-power distribution module and the connected elongated blade.

7. An electronic display according to claim 3 wherein the at least one elongated blade is coupled to the second elongated blade by a common frame.

8. An electronic display according to claim 7 wherein the common frame is connected to each elongated blade at the rear surface thereof via a releasable connector that is accessible from the LED array side of the electronic display.

9. An electronic display according to claim 1 wherein at least one elongated blade is connected at a least side to a second and laterally adjacent elongated blade at the lateral side thereof in a tiled arrangement so that the spacing between the pixels at the adjacent vertical edges of each elongated display board is the same as the spacing between the pixels within each elongated display board.

10. An electronic display according to claim 1 wherein the signal-power distribution module further comprises a second front connector on the front, wherein each of the first and second connector are in mated engagement with the rear terminal connecters on laterally adjacent elongated display board for distributing signals and power to the LED's of the LED arrays thereon.

11. An electronic display according to claim 6 wherein each elongated blade is releasably attached to the hinges, the releasable attachment being accessible from the LED containing side of the LED array so that the elongated blade is removable from the hinges from the front surface of the elongated display boards disposed thereon without the need to remove adjacent elongated blades.

12. An electronic display according to claim 6 wherein the signal power distribution module comprises a power distribution board that is in at least one of power and signal connection with the at least one cable to provide routing thereof to two laterally adjacent elongated display board.

13. An electronic display according to claim 12 wherein the routing of the at least one of power and signal from the cable to the power distribution board of at least one elongated blade is through an aperture in a hinge that supports the elongated board and at least two elongated display boards disposed thereon.

14. An electronic display according to claim 13 wherein each elongated blade is releasably attached to the hinges, the releasable attachment being accessible from the LED containing side of the LED array so that the elongated blade is removable from the hinges from the front surface of the elongated display board disposed thereon without the need to remove adjacent elongated blades.

15. An electronic display according to claim 1 in which the signal-power power cable transmits both signal and power to the signal-power module to energize selected LED's in the LED array.

16. An electronic display according to claim 6 wherein the linked hinges have a rotatingly engaging means that is disposed at a center of gravity of the elongated blade and the hinges connected thereto.

17. A process for erecting a large scale portable display, the process comprising the steps of:

a) providing a protective containment means, b) providing the display according to claim 6 in a coiled configuration in the containment means, wherein the axle is in rotary engagement with the opposite ends thereof, c) rotating the axle to deploy the display from the coiled configuration in the containment means.

18. A flexible electronic display comprising:

a) a plurality of horizontally elongated substantially rigid members in a vertical array, each rigid member having a front and rear surface and containing a plurality of LED's laterally arrayed to form regularly spaced pixels, the plurality of LED's being connected to a power and signal control module on each rigid member, b) a flexible signal and power connection between each of the control module on adjacent rigid members, c) wherein each of the rigid members in each vertical array is connected to at least one of an upper or lower adjacent rigid member by a plurality of flexible mating hinges, each having a front side and a back side, d) wherein the rigid members are disposed on the front side of the flexible mating hinges and at least a portion of the a flexible signal and power connection is disposed behind the back side thereof.

19. A flexible electronic display according to claim 18 wherein a plurality of the flexible mating hinges have a rotatingly engaging means that is disposed at a center of gravity of the rigid member support thereon.

20. A portable display comprising:

a) an axle, b) a plurality of flexible supporting means attached to said axle in a laterally spaced apart relationship along said axle, c) a flexible electronic display surface comprising;

(1) a plurality of horizontally elongated substantially rigid elements in a vertical array, each rigid element having a front and rear surface and containing a plurality of LED's laterally arrayed to form regularly spaced pixels, the plurality of LED's being connected to a power and signal control module on each rigid element, (2)a flexible signal and power connection between each of the control module on adjacent rigid elements, d) a bar secured to opposite ends of said flexible supporting means from said axle, e) wherein each flexible supporting means is attached to the rear surface of the rigid elements in each vertical array wherein tensioning said flexible supporting means provides the regular vertical spacing of the LED's on adjacent rigid elements to provide a uniform spacing of the pixels within and between each of the horizontally elongated substantially rigid in said plurality thereof.

21. A portable display transporter comprising:

a) an elongated vehicle chassis having a least two spaced apart wheels disposed on opposite sides thereof;

b) a containment means for containing a rolled flexible display disposed on said chassis having at least one opening face, c) at least one rigid support members capable of extending vertically above the chassis at the end of the containment means, each rigid support member having a coupling for driving the upright travel of the flexible array as it is unwound from said containment means.

* * * * *